US005736981A

United States Patent [19]

Nobutani et al.

[11] Patent Number: 5,736,981

[45] Date of Patent: Apr. 7, 1998

[54] DISPLAY CONTROL APPARATUS

[75] Inventors: Toshiyuki Nobutani, Yokohama; Masami Shimakura, Tokyo; Junichi Tanahashi, Yokohama; Kenichiro Ono, Kawasaki; Hajime Morimoto, Tokyo; Tatsuya Sakashita, Yokohama; Eiichi Matsuzaki, Kawasaki, all of Japan

[73] Assignee: Canon Kabushiki Kaisha, Tokyo, Japan

[21] Appl. No.: 711,459

[22] Filed: Sep. 6, 1996

Related U.S. Application Data

[63] Continuation of Ser. No. 115,029, Sep. 2, 1993, abandoned.

[30] Foreign Application Priority Data

Sep. 4, 1992 [JP] Japan ..... 4-237209
Sep. 7, 1992 [JP] Japan ..... 4-238427

[51] Int. Cl.[6] ..... G09G 5/00

[52] U.S. Cl. ..... 345/185; 345/145; 345/98; 345/87

[58] Field of Search ..... 345/185, 87, 97, 345/94, 55, 100, 145, 146, 98; 359/54, 55, 56; 348/790, 792, 793; 349/33, 34; 395/501, 507, 515

[56] References Cited

U.S. PATENT DOCUMENTS 4,693,563 9/1987 Harada et al. ..... 345/97
4,964,699 10/1990 Inoue ..... 350/332
5,091,723 2/1992 Kanno et al. ..... 345/94
5,099,331 3/1992 Truong ..... 345/113
5,289,173 2/1994 Numao ..... 345/87
5,408,247 4/1995 Enomoto et al. ..... 345/100

FOREIGN PATENT DOCUMENTS 0361471 4/1990 European Pat. Off. .
0368117 5/1990 European Pat. Off. .

*Primary Examiner*—Dennis-Doon Chow
*Attorney, Agent, or Firm*—Fitzpatrick, Cella, Harper & Scinto

[57] ABSTRACT

A display control apparatus for a display device, capable of updating a display state for a display element subjected to a change in display updating, includes a display data memory for storing display data, and a display controller capable of sequentially reading out the display data stored in the memory and transferring the readout display data to the display device at a predetermined period and capable of performing a partial rewrite operation of the display data stored in the memory. A rewrite detector detects an address for accessing the display data memory to cause the display controller to perform the partial rewrite operation, a specific pattern rewrite detector detects an address of display data subjected to a rewrite operation of the specific pattern and stored in the display data memory, and a rewrite address generator preferentially transfers the address detected by the specific pattern rewrite detector over the address detected by the rewrite detector, reads out the display data from the display data memory at the transferred address, and transfers the readout data to the display device.

20 Claims, 43 Drawing Sheets

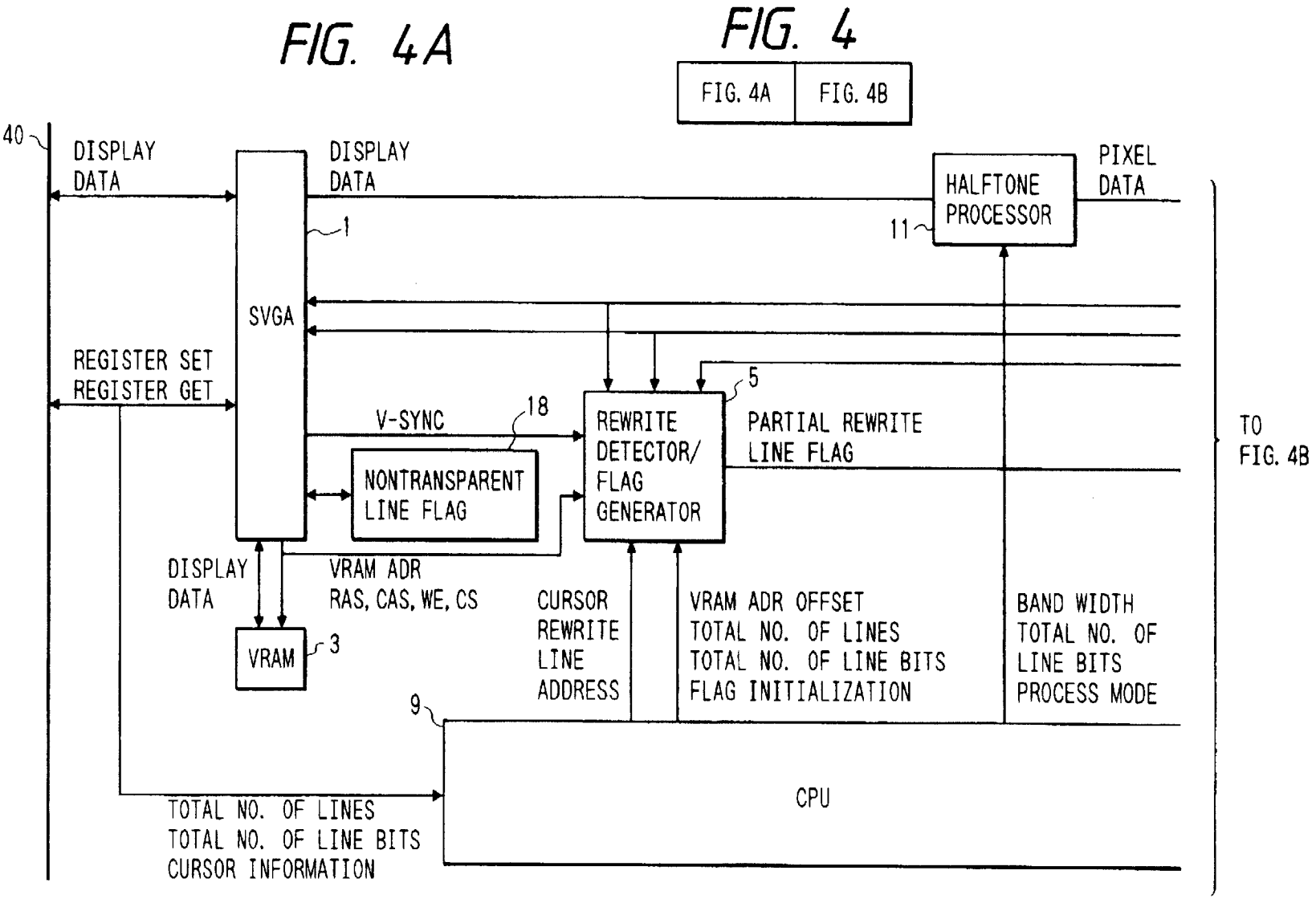
FIG. 4
FIG. 4A
FIG. 4B
FIG. 4A
TO FIG. 4B
PIXEL DATA
HALFTONE PROCESSOR
11
BAND WIDTH
TOTAL NO. OF LINE BITS
PROCESS MODE
PARTIAL REWRITE LINE FLAG
5
REWRITE DETECTOR/ FLAG GENERATOR
VRAM ADR OFFSET
TOTAL NO. OF LINES
TOTAL NO. OF LINE BITS
FLAG INITIALIZATION
CPU
CURSOR REWRITE LINE ADDRESS
18
NONTRANSPARENT LINE FLAG
V-SYNC
VRAM ADR
RAS, CAS, WE, CS
9
DISPLAY DATA
1
SVGA
3
VRAM
DISPLAY DATA
TOTAL NO. OF LINES
TOTAL NO. OF LINE BITS
CURSOR INFORMATION
DISPLAY DATA
REGISTER SET
REGISTER GET
40

| AND PATTERN MEM | XOR PATTERN MEM | SUPERIMPOSITION OUTPUT |
|---|---|---|
| 0 | 0 | OFF (BLACK) |
| 0 | 1 | ON (WHITE) |
| 1 | 0 | TRANSPARENT |
| 1 | 1 | INVERT |

FIG. 23

BEFORE TRANSFER OF BUFFER FLAG INFORMATION

| SCAN LINE | | 521 | 522 |
|---|---|---|---|
| | 1 | 0 | 0 |
| | 2 | 0 | 0 |
| | 3 | 0 | 0 |
| | 4 | 0 | 0 |
| | 5 | 0 | 0 |
| | 6 | 0 | 0 |
| | 7 | 0 | 1 |
| | 8 | 0 | 1 |
| | 9 | 0 | 1 |
| | 10 | 0 | 1 |
| | 11 | 0 | 1 |
| | 12 | 0 | 1 |
| | 13 | 0 | 1 |
| | 14 | 0 | 0 |
| | 15 | 0 | 0 |
| | 16 | 0 | 0 |
| | 17 | 0 | 0 |
| | 18 | 0 | 1 |
| | 19 | 0 | 1 |
| | 20 | 0 | 1 |
| | 1020 | 0 | 0 |
| | 1021 | 0 | 0 |
| | 1022 | 0 | 0 |
| | 1023 | 0 | 0 |
| | 1024 | 0 | 0 |

FIG. 24

AFTER TRANSFER OF BUFFER FLAG INFORMATION

| SCAN LINE | | 521 | 522 |
|---|---|---|---|
| | 1 | 0 | 0 |
| | 2 | 0 | 0 |
| | 3 | 0 | 1 |
| | 4 | 0 | 1 |
| | 5 | 1 | 0 |
| | 6 | 1 | 0 |
| | 7 | 1 | 1 |
| | 8 | 1 | 1 |
| | 9 | 1 | 1 |
| | 10 | 1 | 1 |
| | 11 | 1 | 1 |
| | 12 | 1 | 1 |
| | 13 | 1 | 1 |
| | 14 | 1 | 0 |
| | 15 | 1 | 0 |
| | 16 | 1 | 0 |
| | 17 | 0 | 0 |
| | 18 | 0 | 1 |
| | 19 | 0 | 1 |
| | 20 | 0 | 1 |
| | 1020 | 0 | 1 |
| | 1021 | 0 | 0 |
| | 1022 | 0 | 0 |
| | 1023 | 0 | 0 |
| | 1024 | 0 | 0 |

DISPLAY CONTROL APPARATUS

This application is a continuation of application Ser. No. 08/115,029, filed Sep. 2, 1993, now abandoned.

BACKGROUND OF THE INVENTION

1. Field of the Invention

The present invention relates to a display control apparatus and, more particularly, to a display control apparatus for a display device having a display element which uses, e.g., a ferroelectric liquid crystal as an operating medium for updating a display state and can hold an updated display state upon application or the like of an electric field.

2. Related Background Art

A display device used as an information display means for achieving a visual information representing function is used in an information processing system or the like. A CRT display device (to be referred to as a CRT hereinafter) is generally used as such a display device.

Various information processing systems such as so-called personal computers are available in accordance with hardware, software, and signal transmission schemes. In this case, CRT display control apparatuses (CRTC) unique to various systems are used. Such CRTCs are exemplified by a VGA81 (available from IBM) as a VGA (Video Graphics Array) dedicated for an information processing system PC-AT (available from IBM) and an 86C911 (available from S3) as an SVGA (Super VGA) obtained such that an accelerator function for displaying predetermined images such as a circle and a rectangle is added to the VGA.

FIG. 1 is a block diagram showing an SVGA arrangement used in a CRTC.

When the host CPU of an information processing system partially rewrites a display memory window area in a host memory space, the rewritten display data is transferred to a VRAM 3 through a system bus 40 and a SVGA 1. The SVGA 1 generates a VRAM address on the basis of the address of the display memory window area and rewrites the display data in the VRAM 3 which is located at this VRAM address.

Meanwhile, the SVGA 1 accesses the VRAM 3 at the same period as the scan period of the CRT and sequentially reads out display data developed in the VRAM 3. The readout data are transferred to a RAMDAC 2. The RAMDAC 2 sequentially converts the input display data into R, G, and B analog signals and transfers the converted analog signals to a CRT 4. The SVGA used as the CRT display control apparatus functions to unconditionally transfer the display data at a predetermined period to the CRT.

In the above CRT display control, since the VRAM 3 comprises a dual port RAM, the VRAM 3 can independently perform an operation of writing display data in the VRAM to update the display information and an operation of reading out the display data from the VRAM. For this reason, the host CPU need not consider display timings and the like at all. Desired display data can be advantageously written at an arbitrary timing.

A CRT requires particularly a length in the direction of thickness of the display screen and has a large volume. It is difficult to obtain a compact CRT as a display device as a whole. This limits the degree of freedom of an information processing system using a CRT as a display. That is, the degrees of freedom in installation locations and portability are decreased.

A liquid crystal display (to be referred to as an LCD hereinafter) can be used as a display device which can compensate for the above drawbacks. More specifically, an LCD can achieve compactness (particularly, a low-profile configuration) of the display device as a whole. Of such LCDs, a display using a liquid crystal cell containing a ferroelectric liquid crystal (to be referred to as an FLC) is available. This display will be referred to as an FLCD hereinafter. One of the characteristic features of the FLCD lies in that the display state of the liquid crystal cell is memorized upon application of an electric field. That is, its liquid crystal cell is sufficiently thin, the elongated FLC molecules in the cell are aligned in the first or second stable states in accordance with an electric field application direction, and the aligned state of the molecules is maintained after the electric field is withdrawn. The FLCD has a memory function due to the above bistable operations of the FLC molecules. The details of the FLC and FLCD are described in U.S. Pat. No. 4,964,699.

Although the FLCD has the above memory function, it has a low FLC display updating speed. The FLCD cannot follow up with changes in display information which must be instantaneously updated. Such operations are exemplified by cursor movement, a character input, and scrolling.

In FLCDs having the above characteristics, various display drive modes which have originated from these characteristics or compensate for these characteristics are available. More specifically, in refresh driving for sequentially and continuously driving scan lines on the display screen as in a CRT and any other liquid crystal display, a relatively large time margin is available in its drive period. In addition to this refresh driving, partial rewrite driving for updating the display state of a part (line) subjected to a change on the display screen and interlace driving for interlacing and driving scan lines on the display screen are also proposed. The display information change speed can be increased by the partial rewrite driving or the interlace driving.

If display control of the FLCD having the above advantages can be performed using an existing CRT display controller, an information processing system using an FLCD as a display device can be arranged at a relatively low cost.

It is difficult to arrange an FLCD having continuous multi-gradation in display color tones as compared with the CRT. As a means for overcoming this difficulty, a binary process is performed in a display having a smaller number of colors in accordance with an error diffusion method, an ED method, or a dither method. Therefore, apparent multi-gradation display is performed.

A hardware cursor is a function of smoothly displaying, on the display screen, a cursor moved on the display screen at high speed, in such a manner that cursor position information and cursor shape information are provided in addition to image information present in the VRAM and are output to the display device using a superimposition function.

In the prior art, however, when the binary process is performed on the display side, information representing whether an object can be processed by the binary process is received from a display control unit in the form of area separation information or is determined on the display side in accordance with the image data contents. In either method, in a sprite representation called a mouse display, when the binary process is performed without area separation, the edge of the sprite is not emphasized to make it difficult to visually recognize the sprite because the sprite is moved on the display screen at high speed. In addition, when the sprite is moved on the display screen, the binary operation of its portion and neighboring pixels may result in an effect image different from the expected one. This degrades the image quality. A pattern designated or instructed and displayed by the sprite function receives the most attention by the user on the display screen. Even slight degradation within a small range cannot be neglected.

The function of supporting the hardware cursor also has the following drawbacks.

(1) When a hardware cursor is moved at high speed, the image of the cursor is distorted in accordance with a partial rewrite sequence.

(2) When a hardware cursor is moved at high speed, a high-speed partial rewrite operation must be performed.

When a partial rewrite operation is performed in a mouse cursor preferential display mode, and the screen rewrite speed is decreased, the display quality of objects moved in synchronism with the mouse cursor undesirably degraded.

FIG. 2 shows a case in which a window is moved in synchronism with a mouse. This case exemplifies a window system such as Microsoft Windows (available from Microsoft). The user moves the mouse cursor to the title bar at the upper portion of the window and drags the cursor to move the window. In this case, the window and the cursor are synchronously moved. When the mouse display has a preference over the window display, the display quality of the moving window is degraded.

An FLCD partial rewrite operation is performed for each horizontal line. When the mouse cursor display has a preference over the line display, the drawing timing of the line on which the mouse cursor is located is shifted from any other line, resulting in poor display.

SUMMARY OF THE INVENTION

It is an object of the present invention to provide a display control apparatus capable of properly performing a partial rewrite operation at a relatively high speed, such as cursor movement, in an FLCD display control using a CRT display controller.

In order to achieve the above object according to an aspect of the present invention, there is provided a display control apparatus for a display device capable of performing updating of a display state for a display element subjected to a change in display, comprising display data memory means for storing display data, a display controller capable of sequentially reading out the display data stored in the memory means and transferring the readout display data to the display device at a predetermined period and capable of performing a partial rewrite operation of the display data stored in the memory means, rewrite detecting means for detecting an address for accessing the display data memory means to cause the display controller to perform the partial rewrite operation, specific pattern rewrite detecting means for detecting an address of display data subjected to a rewrite operation of the specific pattern and stored in the display data memory means, and rewrite address generating means for preferentially transferring the address detected by the specific pattern rewrite detecting means over the address detected by the rewrite detecting means, reading out the display data from the display data memory means at the transferred address, and transferring the readout data to the display device.

In order to achieve the above object according to another aspect of the present invention, there is provided a display control apparatus for a display device capable of performing updating of a display state for only a display element subjected to a change in display, comprising display data memory means for storing display data, a display controller capable of sequentially reading out the display data stored in the memory means and transferring the readout display data to the display device at a predetermined period and capable of performing a partial rewrite operation of the display data stored in the memory means, specific pattern rewrite detecting means for detecting addresses of display data located in the display data memory means at predetermined positions among a plurality of display data subjected to a rewrite operation of a specific pattern, and rewrite address generating means for generating addresses of the plurality of display data except for the display data whose addresses are detected by the specific pattern rewrite detecting means, performing transfer of the detected addresses and the generated addresses to the display controller, reading out the display data having the addresses in the transfer from the display data memory means, and transferring the readout display data to the display device.

In order to achieve the above object according to still another aspect of the present invention, there is provided a display control apparatus for a display device capable of performing updating of a display state for only a display element subjected to a change in display, comprising display data memory means for storing display data, a display controller capable of sequentially reading out the display data stored in the memory means and transferring the readout display data to the display device at a predetermined period and capable of performing a partial rewrite operation of the display data stored in the memory means, rewrite detecting means for detecting addresses for accessing the display data memory means to cause the display controller to perform the partial rewrite operation, specific pattern rewrite detecting means for detecting an address of the display data subjected to a rewrite operation of the specific pattern in the display data memory means, and read inhibiting means for inhibiting a read operation of the display controller for display data displayed in a transparent manner on the display device among the display data whose addresses are detected by the specific pattern rewrite detecting means.

With the above arrangements, a specific pattern partial rewrite operation such as cursor movement can be preferentially performed.

The volume of specific pattern rewrite information is reduced, and the rewrite operation can be performed at high speed.

It is another object of the present invention to solve the conventional drawbacks described above, wherein a sprite operation is performed independently of a binary process when the binary process is performed on a display unit.

The present invention comprises storage means for storing display data, means for performing a binary process of the display data, memory means for storing a position of a cursor, means for synthesizing the binary display data and the cursor based on the position stored in the memory means, and display control means for displaying the display data on display means.

The present invention comprises storing display data, converting the display data into binary data, synthesizing the binary data with a cursor based on cursor position information, and displaying the synthesized display data.

It is still another object of the present invention to perform the partial rewrite operation of the cursor in accordance with interlace partial rewrite driving during movement of the hardware cursor to improve the drawing performance during movement of the hardware cursor.

According to still another aspect of the present invention, there is provided a display control apparatus for a display device capable of performing updating of a display state for a display element subjected to a change in display, comprising storage means for storing display data, shape storage means for storing a first cursor shape and a second cursor shape, memory means for storing display position information of a cursor, and control means for displaying the cursor in the first cursor shape when the detecting means detects that the cursor is being moved and for displaying the cursor in the second cursor shape the when the detecting means detects that the cursor is not being moved.

Furthermore, according to the present invention, there is provided a display control method for a display device, capable of performing updating of a display state for a display element subjected to a change in display, comprising detecting movement of a cursor, displaying the cursor on display means in a first cursor shape during movement of the cursor, and displaying the cursor on the display means in a second cursor shape during halt of the cursor.

It is still another object of the present invention to determine the presence/absence of an area moved in synchronism with a mouse cursor, preferentially display the mouse cursor when the absence of the region moved in synchronism with the mouse cursor is detected, inhibit preferential display of the mouse cursor when the presence of the area moved in synchronism with the mouse cursor is detected, and improve the display quality of the area.

According to the present invention, there is also provided a display control apparatus for a display device capable of performing updating of a display state for a display element subjected to a change in display, comprising storage means for storing display data, means for detecting movement of a cursor and the presence/absence of an area moved in synchronism with the cursor, and display control means for preferentially displaying the cursor when the absence of the area moved in synchronism with the cursor is detected.

According to the present invention, there is also provided a display control method for a display device capable of performing updating of a display state for a display element subjected to a change in display, comprising detecting movement of a cursor and the presence/absence of an area moved in synchronism with the cursor, and preferentially displaying the cursor over display of the display data when the absence of the area moved in synchronism with the cursor is detected.

With the above arrangement, display control corresponding to the movement of the cursor can be performed on the basis of its movement.

BRIEF DESCRIPTION OF THE DRAWINGS

FIG. 23 is a view illustrating a rewrite flag register before data transfer in the above process;

FIG. 24 is a view illustrating a rewrite flag register after data transfer in the above process;

DETAILED DESCRIPTION OF THE PREFERRED EMBODIMENTS

Preferred embodiments of the present invention will be described in detail with reference to the accompanying drawings.

Figure 1:
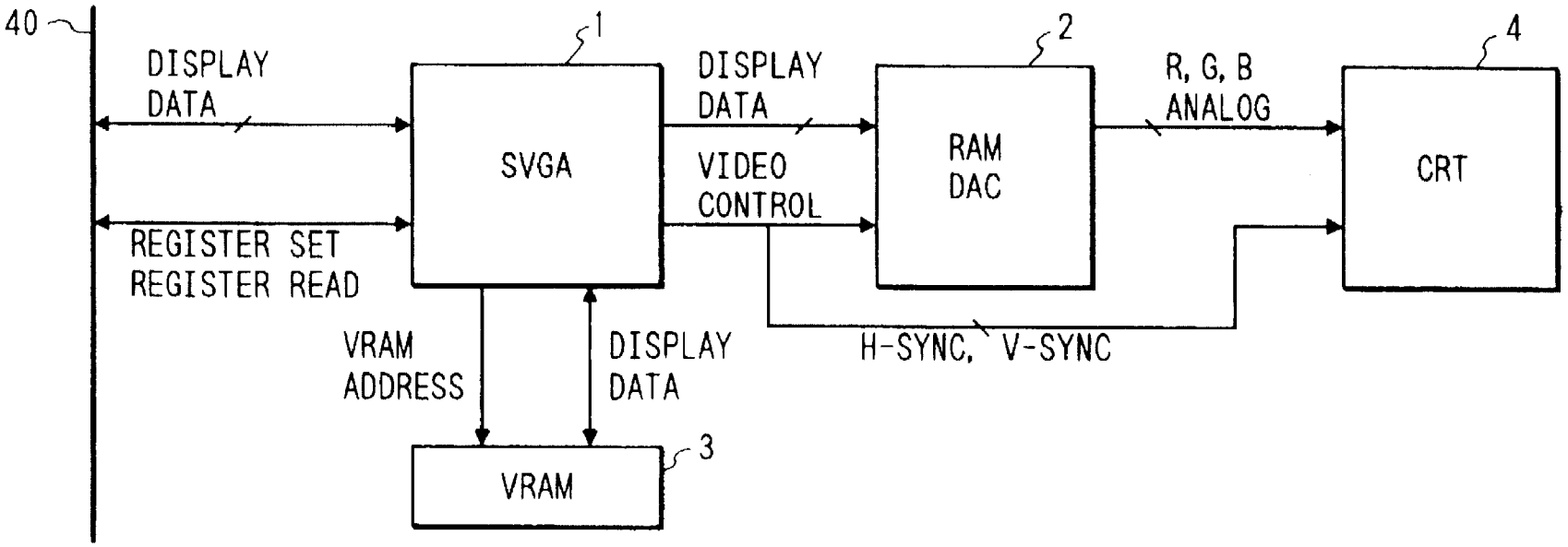
FIG. 1 PRIOR ART
FIG. 1 is a block diagram showing a conventional display control apparatus.
Figure 2:
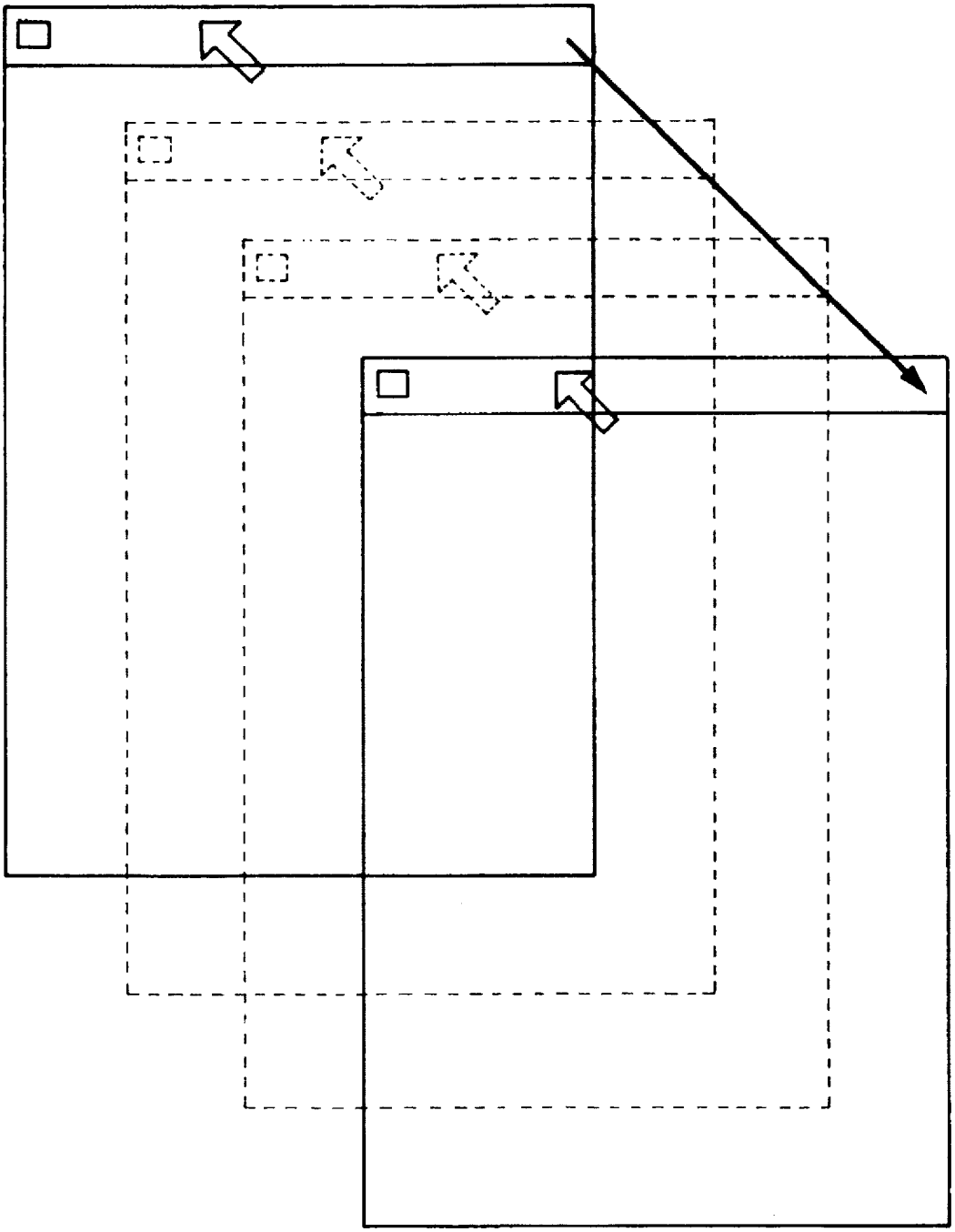
FIG. 2 is a view showing an area moved in synchronism with a mouse.
Figure 3:
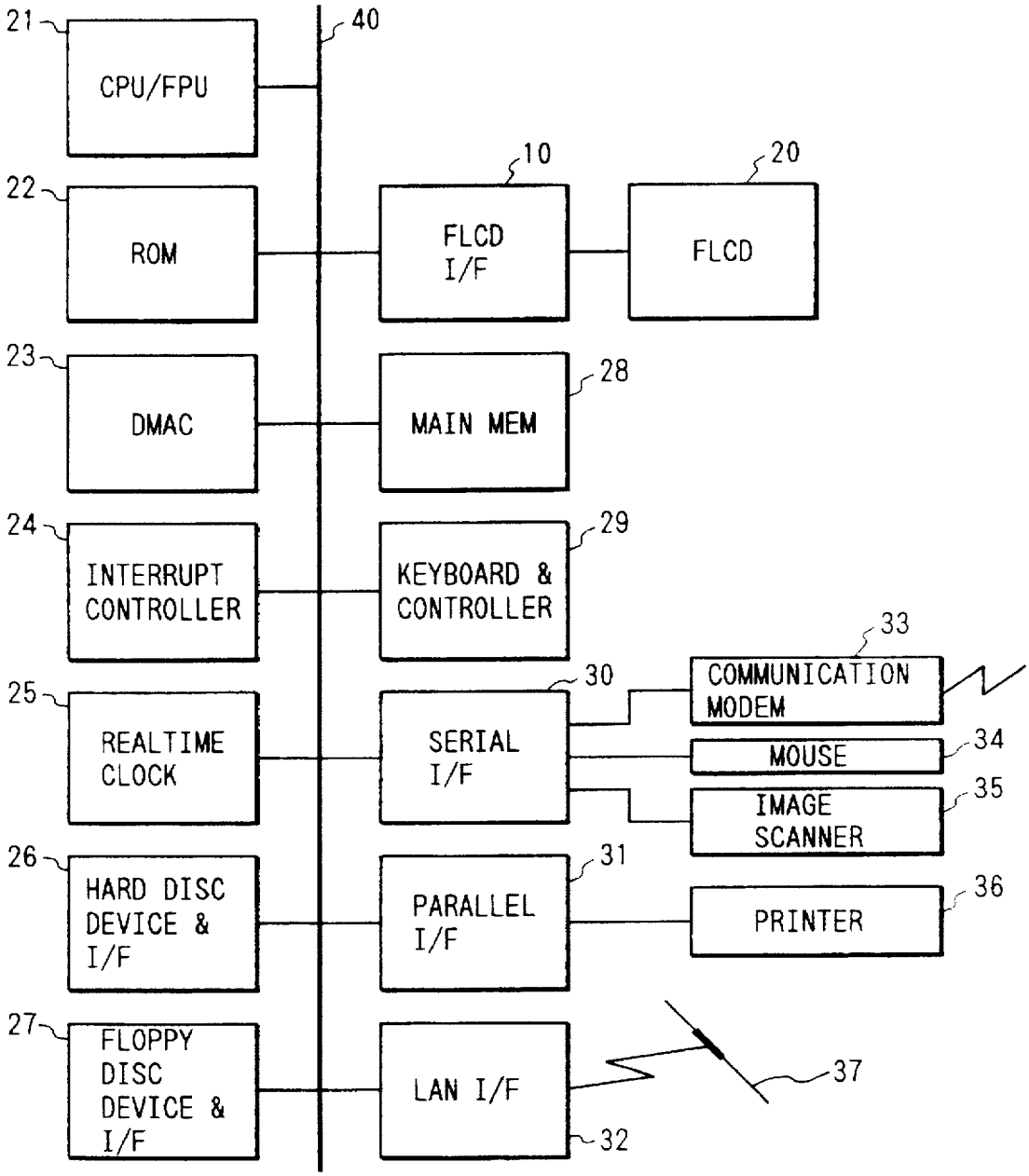
FIG. 3 is a block diagram showing an information processing system according to the first embodiment of the present invention.

FIG. 3 is a block diagram of an information processing system in which an FLC display device having a display control apparatus according to an embodiment of the present invention is used as a display device. for displaying various characters and image information.

Referring to FIG. 3. the information processing system includes a CPU 21. a ROM 22. a main memory 28. a DMA controller (Direct Memory Access Controller; to be referred to as a DMAC hereinafter) 23. a LAN (Local Area Network) interface 32. a hard disk device & I/F 26. a LAN 37. a floppy disk device & I/F 27. a printer 36. a parallel I/F 31. a keyboard & controller 29. a communication modem 33. a mouse 34. an image scanner 35. a serial I/F 30. an interrupt controller 24. a real time clock 25. an FLC display device (FLCD) 20. an FLCD interface 10. a system bus 40. The CPU 21 controls the overall information processing system. The ROM 22 stores programs executed by the CPU 21. The main memory 28 is used as a work area or the like in execution of programs. The DMAC 23 transfers data between the main memory 28 and the respective components constituting this system without control of the CPU 21. The LAN I/F 32 serves as an interface between the LAN 37 such as Ethernet (available from XEROX) and this system. The printer 36 can be constituted by an ink-jet or laser beam printer capable of performing recording at a relatively high resolution. The parallel I/F 31 connects signals between the printer and this system. The keyboard & controller 29 inputs information such as character information (e.g., various characters) and control information. The communication modem 33 performs signal modulation between the communication line and this system. The mouse 34 serves as a pointing device. The image scanner 35 reads an image or the like. The communication modem 33. the mouse 34. and the image scanner 35 exchange signals with this system through the serial I/F 30. The interrupt controller 24 controls an interrupt operation in execution of a propram. The real time clock 25 controls a timepiece function in this system. The display operation of the FLCD 20 is controlled by the FLCD interface 10 serving as the display control apparatus of this embodiment. The FLCD 20 has a display screen using the ferroelectric liquid crystal as a display operating medium. A display memory window area which can be accessed by the CPU 21 is also developed in the FLCD I/F 10. The system bus 40 comprises a data bus. a control bus. and an address bus to connect signals between the respective components.

In the information processing system in which the above components are connected. a user generally performs operations in correspondence with various kinds of information displayed on the display screen of the FLCD 20. More specifically. character information and image information which are supplied from an external device connected to the LAN 37. the hard disk device & I/F 26. the floppy disk device & I/F 27. the scanner 35. the keyboard & controller 29. and the mouse 34. and operation information stored in the main memory 28 upon operations of the user for the system are displayed on the display screen of the FLCD 20. The user performs information editing and operations for instructing the system while observing the display contents on the FLCD 20. The above components constitute a display information supply means for the FLCD 20.

First Embodiment

Figure 4B:
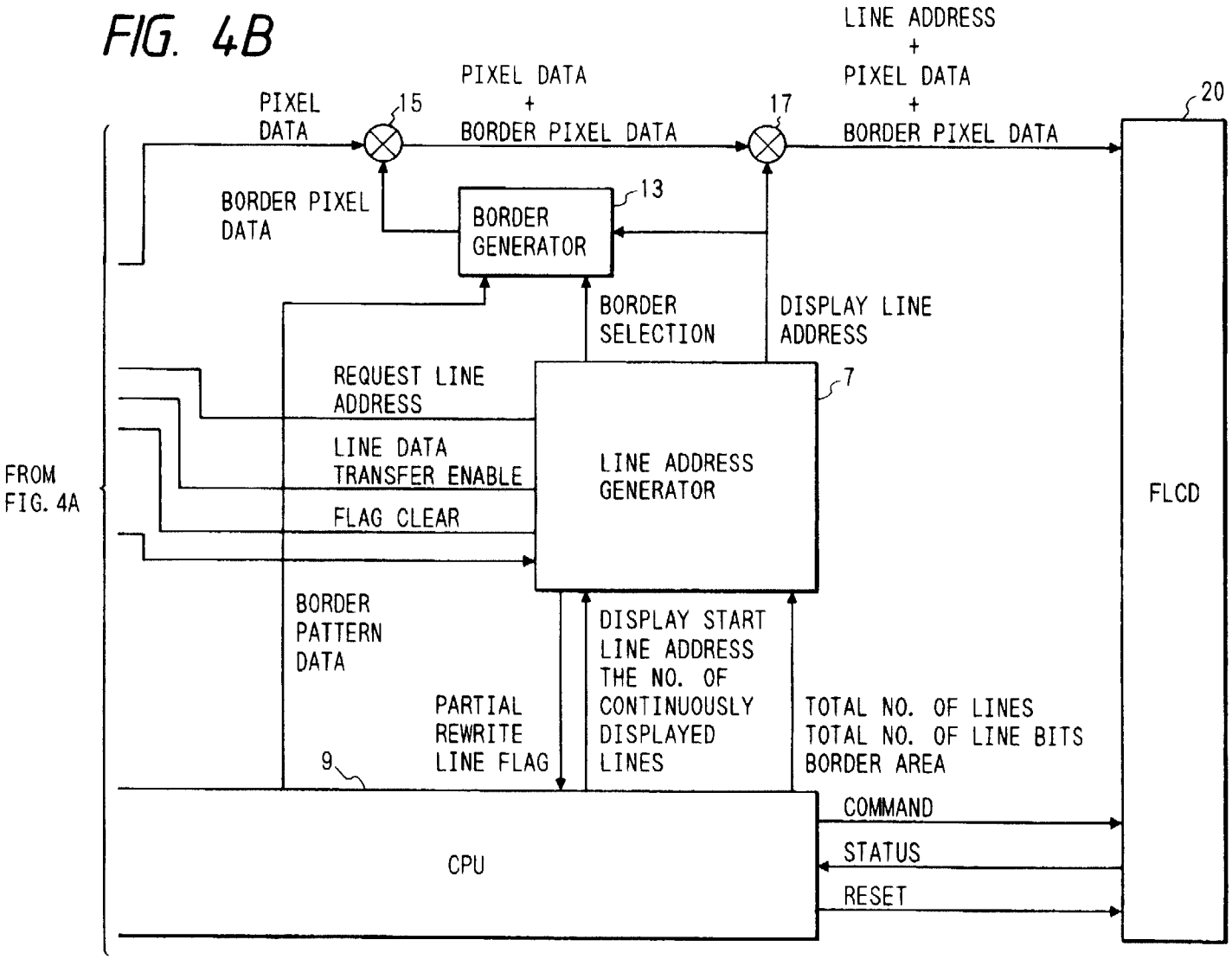
FIG. 4 is comprised of FIGS. 4A and 4B showing block diagrams of a display control apparatus according to the first embodiment of the present invention.

FIGS. 4A and 4B are block diagrams showing the detailed arrangement of the FLCD I/F 10 according to the first embodiment of the present invention;

Referring to FIG. 4B. an SVGA 1 using the exiting SVGA serving as a CRT display controller is used in the FLCD I/F 10. i.e.. the display control apparatus. The arrangement of the SVGA 1 will be described with reference to FIG. 5.

Figure 5:
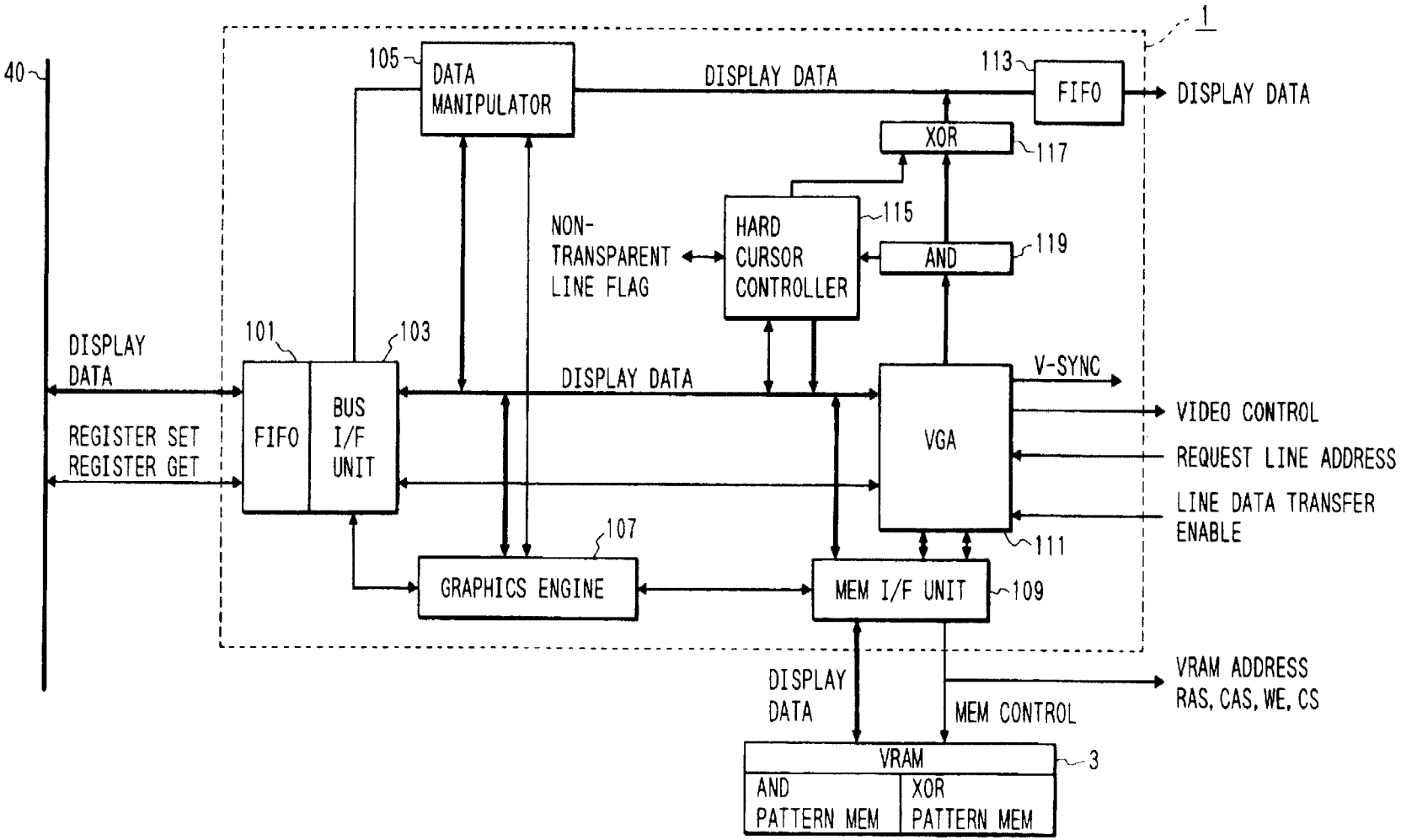
FIG. 5 is a block diagram showing the detailed arrangement of an SVGA shown in FIG. 4A.

Referring to FIG. 5. rewrite display data accessed by the host CPU 21 (FIG. 3) to perform a rewrite operation in the display memory window area of the FLCD I/F 10 (FIG. 3) is transferred through the system bus 40 and temporarily stored in a FIFO 101. Bank address data for mapping the display memory window area on an arbitrary area of a VRAM 3 is also transferred through the system bus 40. Display data has a form of 24 bits for expressing 256 gradation levels for each of the R. G. and B components. Control information such as a command and the bank address data from the CPU 21 is transferred in the form of register set data. Register get data for allowing the CPU 21 to detect the state on the SVGA side is transferred to the CPU 21. The register set data and the display data which are stored in the FIFO 101 are sequentially input. so that the registers in a bus I/F unit 103 and a VGA 111 are set in accordance with the output data. The VGA can know a bank address. its display data. and a control command in accordance with the set states of these registers.

The VGA 111 generates a VRAM address for the VRAM 3 on the basis of the address of the display memory window area and the bank address. At the same time. the VGA 111 transfers strobe signals RAS and CAS. a chip select signal CS. and a write enable signal WE. all of which serve as memory control signals. to the VRAM 3 through a memory I/F unit 109. thereby writing the display data at a position designated by the VRAM address. At this time. the display data to be rewritten is transferred to the VRAM 3 through the memory I/F unit 109.

On the other hand. in response to a line data transfer enable signal transferred from a line address generator 7 (FIG. 4B). the VGA 111 reads out the display data from the VRAM 3 which is specified by a request line address transferred from the line address generator 7. The VGA 111 then stores the readout data in a FIFO 113. The display data is sent from the FIFO 113 to the FLCD side in the display data storage order. At this time, the display data is sent through a circuit for performing a partial rewrite operation for cursor display. This circuit is constituted by a hard cursor controller 115, an AND circuit 119 for logically ANDing the signal from the hard cursor controller 115 and the display data, and an XOR circuit 117 for logically XOR-operating an output from the AND circuit 119 and the signal from the hard cursor controller 115. The hard cursor controller 115 controls operations when a cursor pattern is written in the VRAM 3 and cursor pattern data is superimposed on the display data. An AND pattern memory and an XOR pattern memory used in the above operations are stored in the VRAM 3. The hard cursor controller 115 detects a display line of a nontransparent portion of a cursor display pattern and sets a flag of a nontransparent flag register 18 (FIG. 4A) on the basis of the detection result.

The SVGA 1 comprises a data manipulator 105 and a graphics engine 107, both of which provide the accelerator function as previously described, in addition to the cursor display circuit. For example, when the CPU 21 sets data associated with a circle, its center, and its radius in the registers of the bus I/F unit 103 to instruct drawing of the circle, the graphics engine 107 generates circle display data, and the data manipulator 105 writes the resultant data in the VRAM 3.

The SVGA 1 described with reference to FIG. 5 can be obtained by slightly modifying the VGA portion of the existing CRT SVGA.

Referring back to FIG. 4A, a rewrite detector/flag generator 5 monitors a VRAM address generated by the SVGA 1 and fetches a VRAM address upon rewriting (writing) of the display data of the VRAM 3, i.e., a VRAM address obtained when the write enable signal and the chip select signal CS go to level "1". The rewrite detector/flag generator 5 calculates a line address on the basis of this VRAM address and data (i.e., a VRAM address offset, the total number of lines, and the total number of line bits) obtained from a CPU 9. The concept of this computation is shown in FIG. 6.

Figure 6:
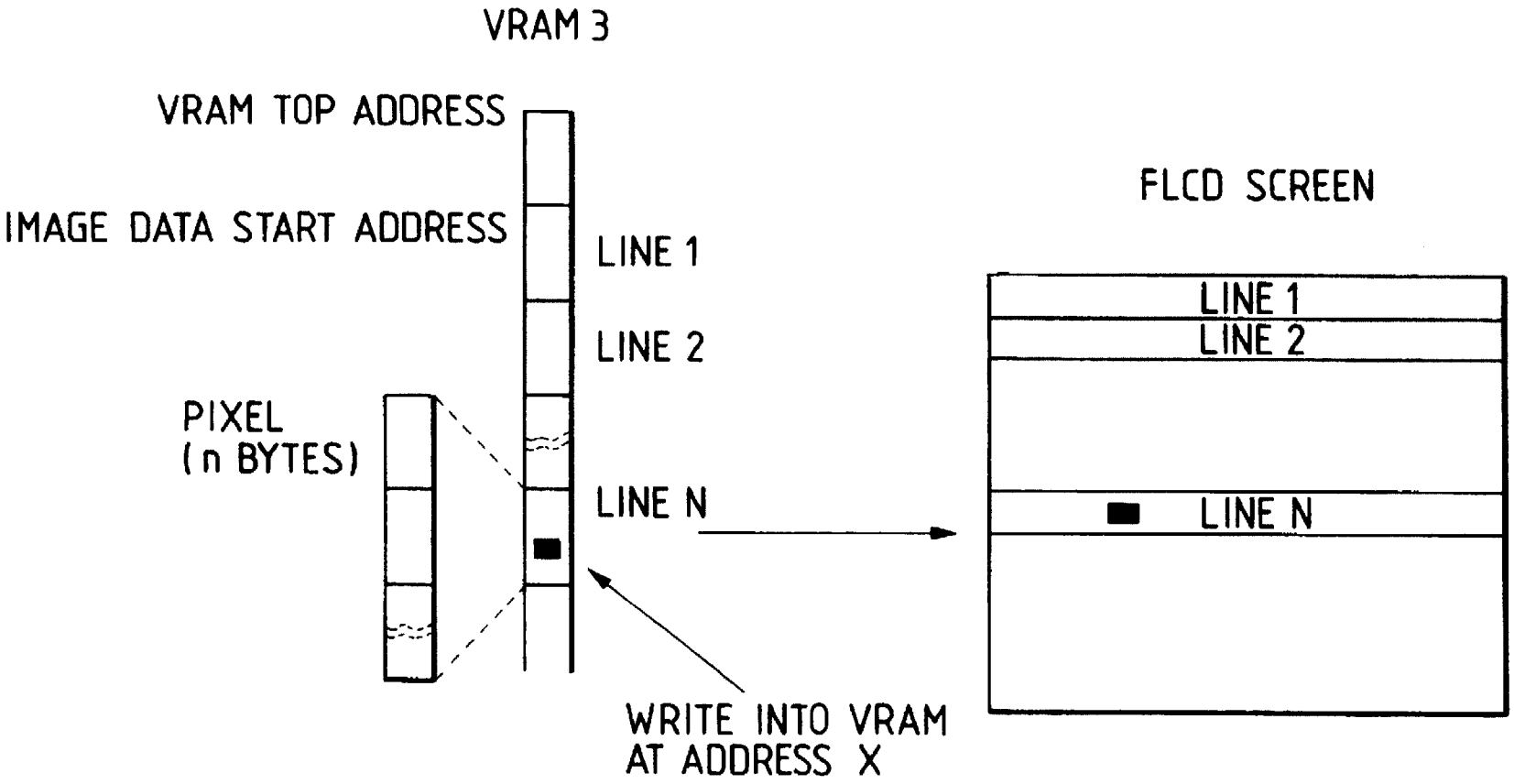
FIG. 6 is a view illustrating conversion from a VRAM address to a line address in the first embodiment of the present invention.

As shown in FIG. 6, a pixel represented by an address X in the VRAM 3 corresponds to a line N on the FLCD screen. One line comprises a plurality of pixels, and each pixel is constituted by a plurality (n) of bytes. At this time, the line address (line number N) is computed as follows.

$$\text{Line No. } N = \frac{(\textit{VRAM}\text{ Address } X) - (\text{Image Data Start Address})}{(\text{Number of Pixels per Line}) \times (\text{Number of Bytes per Pixel})} + 1$$

The rewrite detector/flag circuit 5 sets its internal partial rewrite line flag register in accordance with the computed line address. This state is shown in FIG. 7.

Figure 7:
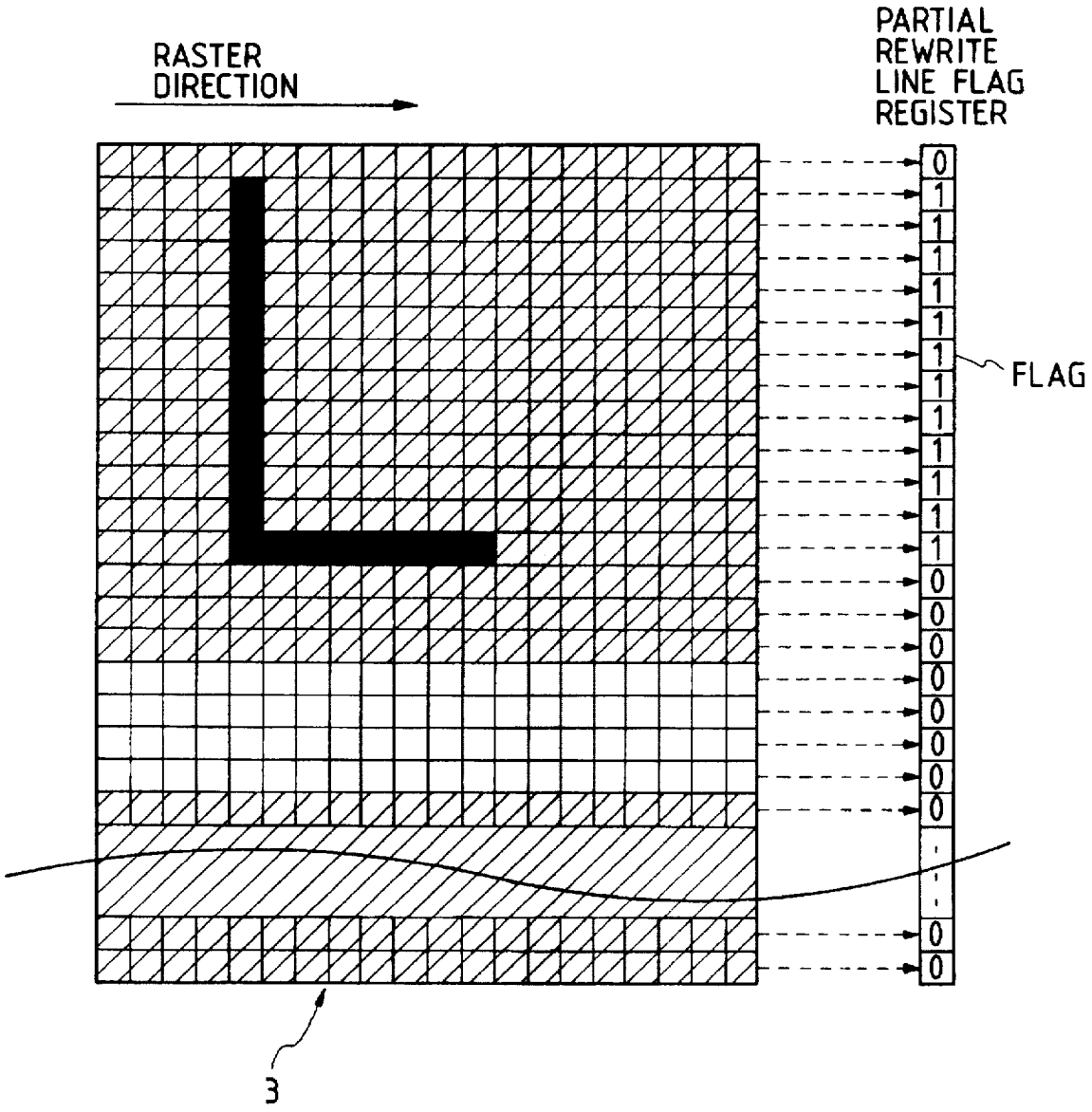
FIG. 7 is a view illustrating a relationship between a rewrite display pixel and a rewrite line flag register according to the first embodiment of the present invention.

As is apparent from FIG. 7, when the address display corresponding to a letter, e.g., "L" in the VRAM 3 is rewritten to display the letter "L", the line address rewritten by the above computation is detected, and a flag is set ("1") in a register corresponding to this address.

The rewrite detector/flag generator 5 includes a circuit for performing a partial rewrite operation for the cursor display in addition to the arrangement for the normal partial rewrite operation described above.

The CPU 9 reads the contents of the rewrite line flag register in the rewrite detector/flag generator 5 and sends the line address, the flag of which is set, to the SVGA 1. At this time, the line address generator 7 sends out a line data transfer enable signal corresponding to the line address data and transfers the display data at the above address from the SVGA 1 (of the FIFO 113) to a halftone processor 11.

The line address generator 7 has an arrangement for preferentially performing a cursor partial rewrite operation (to be described later).

Figure 8:
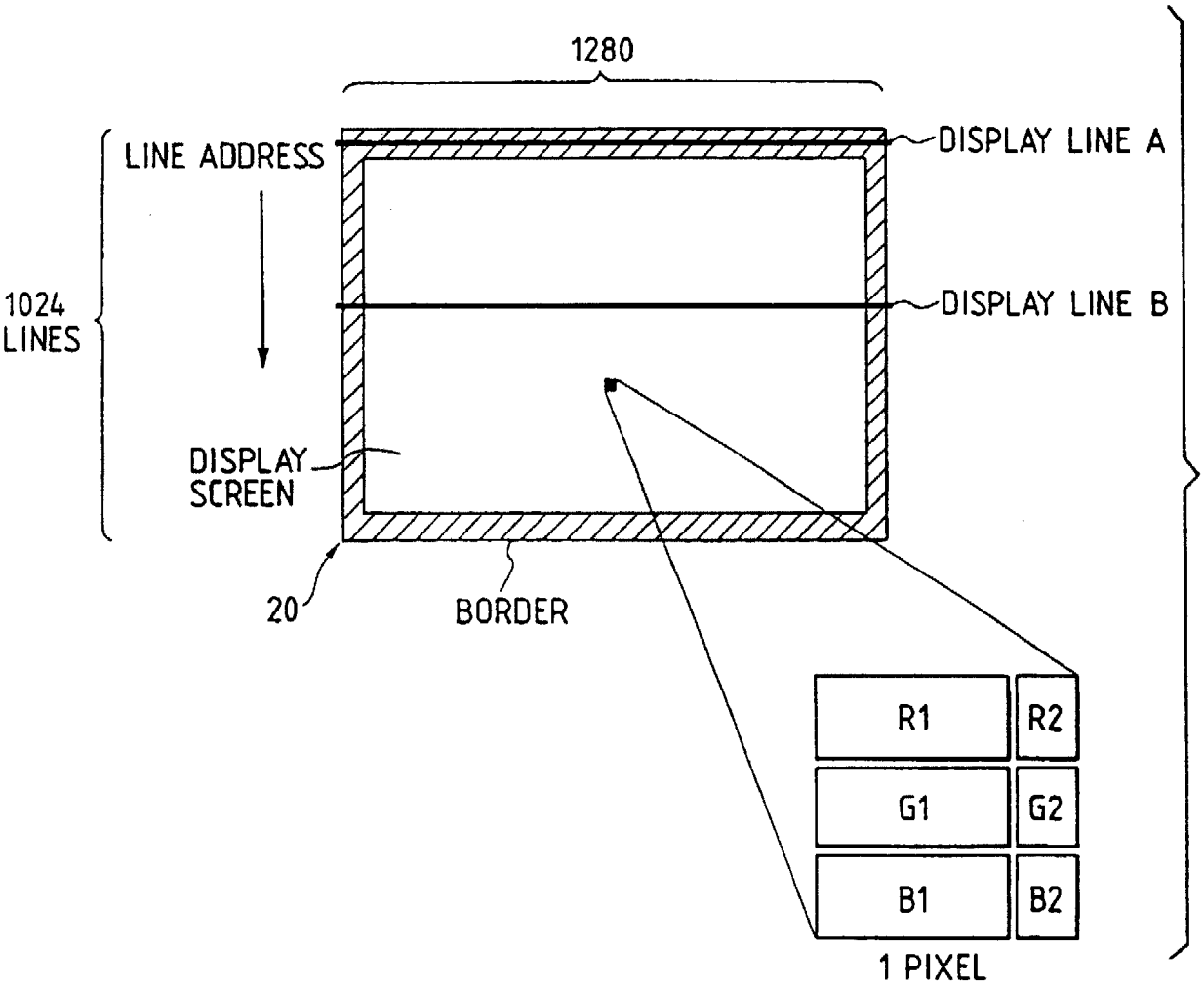
FIG. 8 is a view illustrating an FLCD display screen according to the first embodiment of the present invention.

The halftone processor 11 converts multi-value (256 gradation levels) data expressed by 8-bit R, G, and B data into binary pixel data corresponding to each pixel on the display screen of the FLCD 20. As shown in FIG. 8, one pixel on the display screen has display cells having different areas for the respective colors, and data corresponding to one pixel has two bits for each color (R1, R2, G1, G2, B1, and B2). Therefore, the halftone processor 11 converts 8-bit display data into binary data having two bits for each color (i.e., four-value data for each color).

The schematic data flow until data is converted into FLCD display pixel data as described above is shown in FIG. 10.

Figure 10:
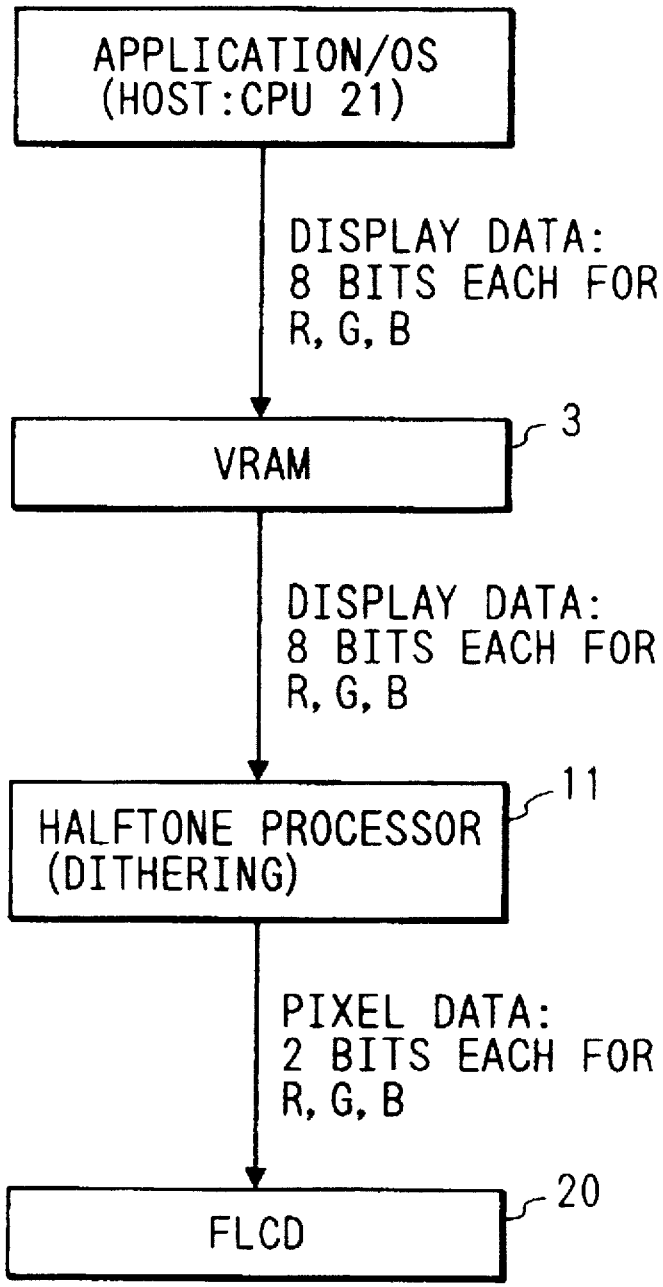
FIG. 10 is a block diagram showing a process flow of display data according to the first embodiment of the present invention.

As is apparent from FIG. 10, display data in the VRAM 3 are stored as 8-bit multi-value data for each of the R, G, and B components. When these data are to be read out and displayed, they are binarized. The host CPU 21 (FIG. 3) can access the FLCD 20 in the same manner as in use of the CRT, thereby assuring compatibility with the CRT.

A technique used in halftone processing can be a known technique such as an error diffusion method, a mean density method, or a dither method.

Referring to FIG. 4B, a boarder generator 13 generates pixel data of a border portion on the display screen of the FLCD. More specifically, as shown in FIG. 8, the display screen of the FLCD 20 has 1,024 lines each consisting of 1,280 pixels. The boarder portion of the display screen which does not contribute to display is formed to surround the remaining display screen portion.

Figure 9A:
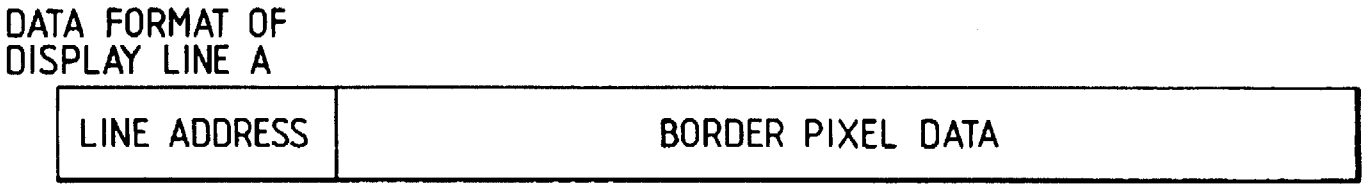
FIGS. 9A and 9B are views illustrating data formats of display data according to the first embodiment of the present invention.
Figure 9B:
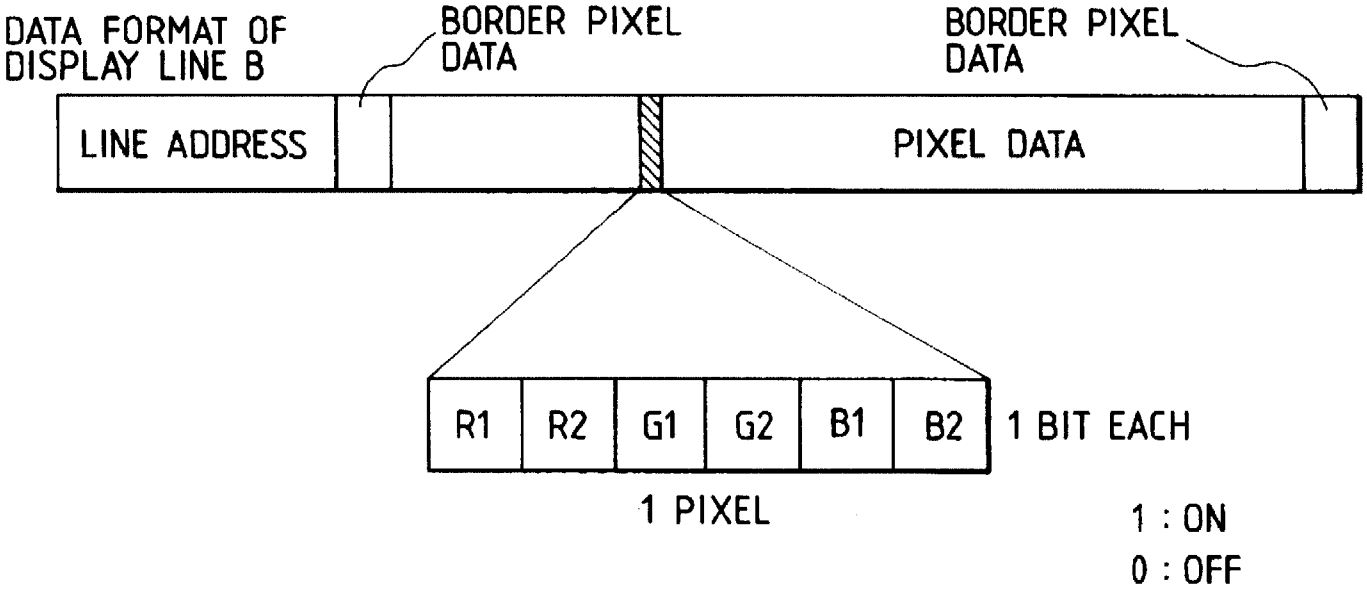

The format of pixel data transferred to the FLCD 20 is defined as the one shown in FIG. 9A or 9B due to the presence of this boarder portion. FIG. 9A is the data format of a display line A (FIG. 8), i.e., all display lines included in the boarder portion. FIG. 9B is the data format of a display line B (FIG. 8), i.e., lines used for display. The data format of the display line A starts with a top line address, and boarder pixel data follows the top line address. To the contrary, since two end portions of the display line B are included in the boarder portion, its data format starts with a line address, and boarder pixel data, pixel data, and boarder pixel data follow the line address in the order named.

The boarder pixel data generated by the boarder generator 13 is serially synthesized with pixel data from the halftone processor 11 in a synthesizing circuit 15. The synthesized data is further synthesized with the display line address from the line address generator 7 by a synthesizing circuit 17. The resultant data is sent to the FLCD 20.

The CPU 9 performs the overall operations described above. More specifically, the CPU 9 receives various kinds of information, i.e., the total number of lines of the display screen, the total number of line bits, and the cursor information from the host CPU 21 (FIG. 3). The CPU 9 sends out various data, i.e., the VRAM address offset, the total number of lines, and the total number of line bits and initializes the line flag register. The CPU 9 also sends out the display start line address, the continuous number of display lines, the total number of lines, the total number of line bits, and boarder area information to the line address generator 7 and receives partial rewrite line flag information from the line address generator 7. The CPU 9 further sends out data, i.e., a band width, the total number of line bits, and a process mode to the halftone processor 11 and the boarder pattern data to the boarder generator 13.

The CPU 9 receives status signals (e.g., temperature information, a Busy signal) from the FLCD 20 and sends out a command signal and a reset signal to the FLCD 20.

In the display control apparatus described with reference to FIGS. 3 to 10, an arrangement for a preferential partial rewrite operation compatible with a relatively high-speed movement such as a cursor movement will be described below.

Figure 11:
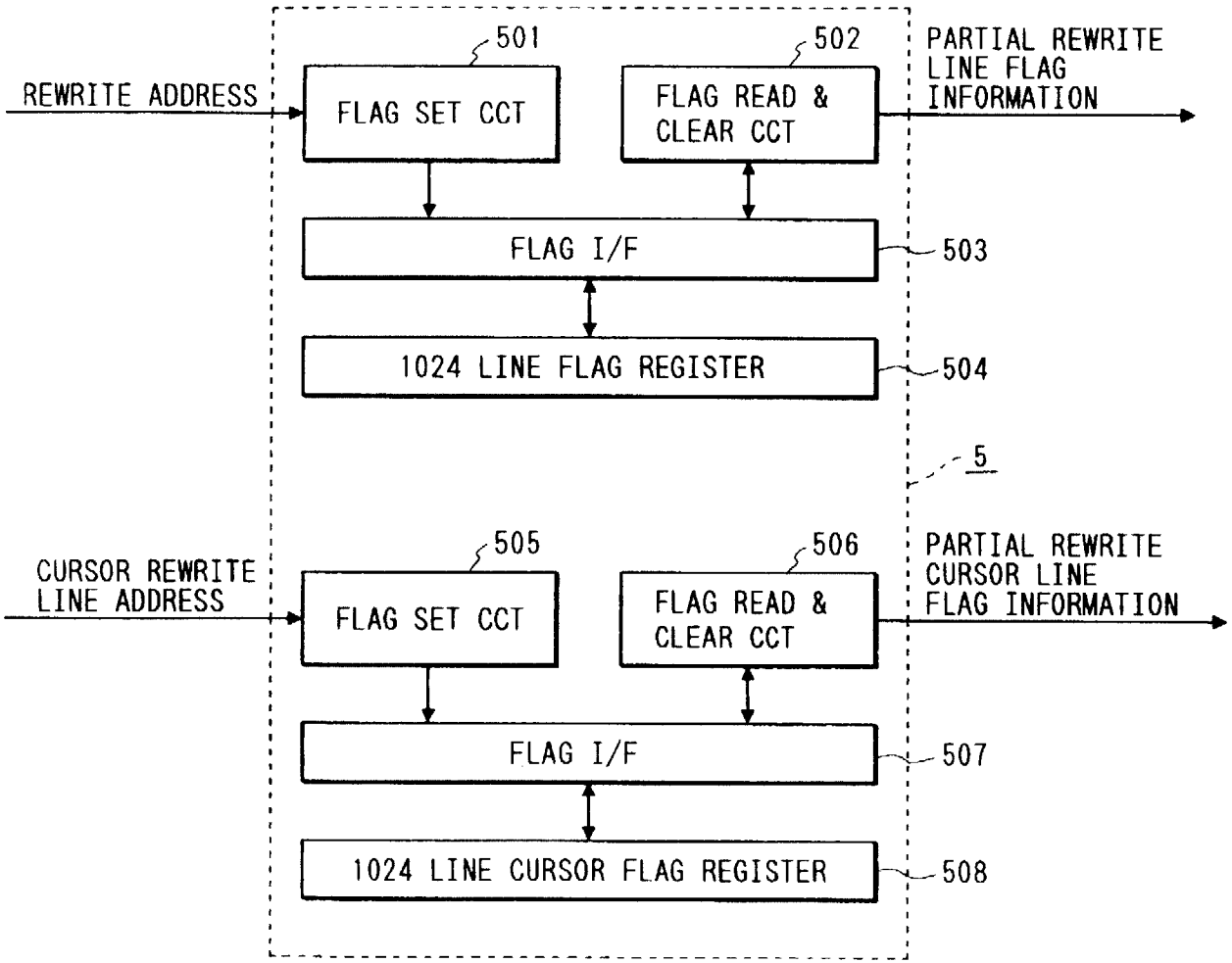
FIG 11 is a block diagram showing the detailed arrangement of a rewrite detector/flag generator shown in FIG. 4A.

FIG. 11 is a block diagram showing the detailed arrangement of the rewrite detector/flag generator 5 shown in FIG. 4A.

The rewrite detector/flag generator 5 includes a circuit for detecting a display data rewrite operation in the VRAM by the SVGA 1 (FIG. 4A), setting this rewrite line flag, and transferring this set flag information. The rewrite detector/flag generator 5 also includes a circuit for detecting a partial rewrite operation associated with a cursor movement (to be referred to as a cursor rewrite operation hereinafter), setting the flag of this rewrite line, and transferring set flag information.

A flag set circuit 501 detects a VRAM address accessed in the VRAM 3 to cause the SVGA 1 to perform a display rewrite operation, converts the VRAM address into the line address, as described above, and sets this line flag in a line flag register 504 through a flag I/F 503. A flag read & clear circuit 502 reads out flag information set by the line flag register 504 through the flag I/F 503 and transfers the readout information to the line address generator 7 (FIG. 4B). At the same time, the flag read & clear circuit 502 clears the contents of the register which are associated with the above read access.

On the other hand, the cursor rewrite line address flag supplied from the CPU 9 (FIGS. 4A and 4B) to the rewrite detector/flag generator 5 is set in a cursor flag register 508 through a flag I/F 507 by a flag get circuit 505. The flag set in the register 508 is read out to a flag read & clear circuit 506 through the flag I/F 507. The readout flag is transferred to the line address generator 7.

The cursor flag set operation of the flag set circuit 505 will be described in detail below.

When a partial rewrite operation for the cursor movement is to be performed, only the address (source top line address) of the top or uppermost line of the cursor pattern before the movement is transferred to the flag set circuit 505. The flag set circuit 505 sets flags of addresses of the remaining lines (e.g., 63 lines). The flag read & clear circuit 506 sequentially reads out these pieces of set flag information in a predetermined order and transfers the readout information to the line address generator 7 and at the same time clears the flags of the registers involving in the read access. Subsequently, only the address (destination top line address) of the top or uppermost line of the cursor pattern after movement is transferred to the flag set circuit 505 and is set together with the flags of the remaining lines in the flag register. This set flag information is transferred to the line address generator 7 by the flag read & clear circuit 506, and the flag of the corresponding register is cleared.

Figure 12:
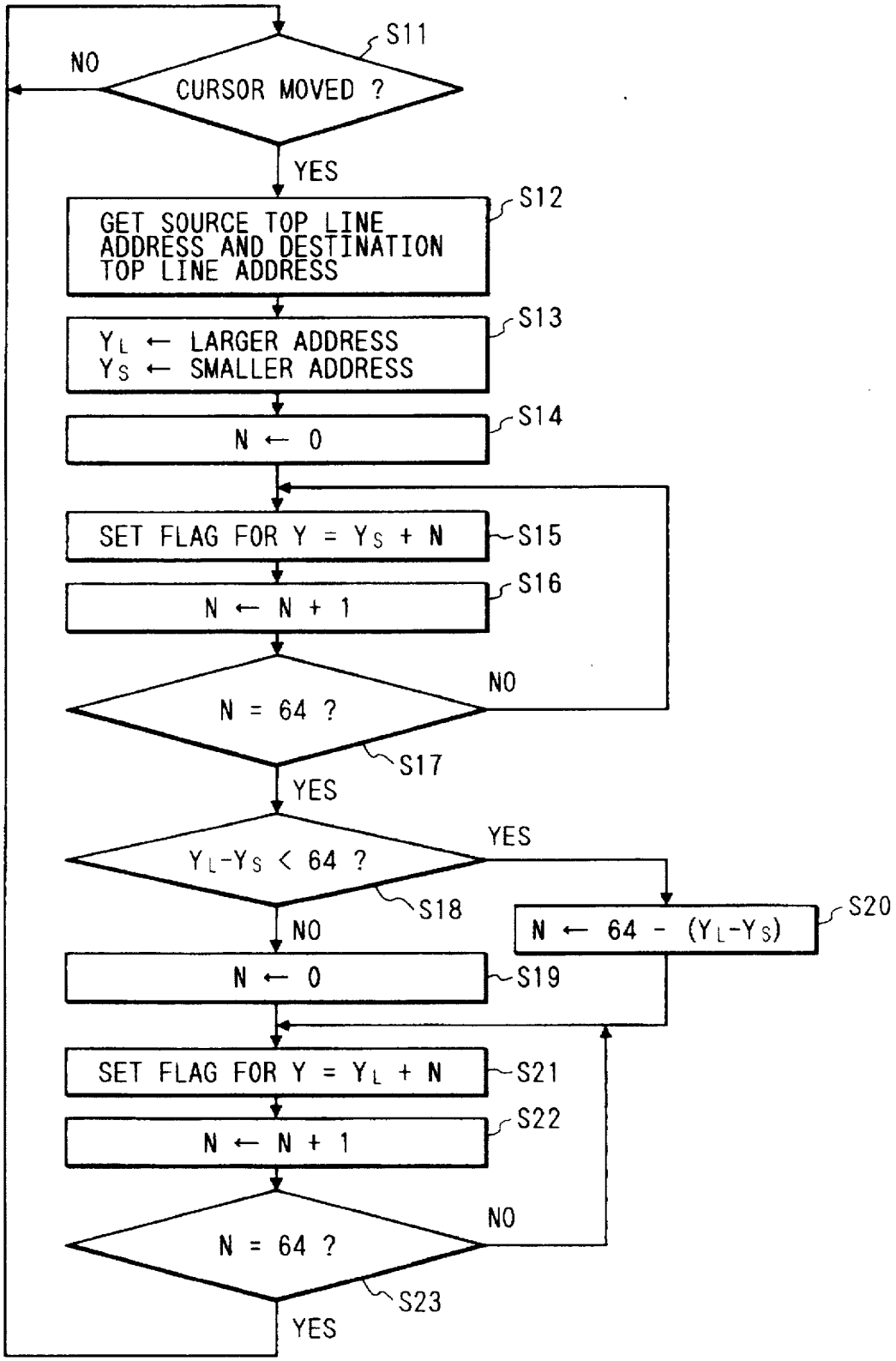
FIG. 12 is a flow chart showing a flag set operation in the rewrite detector/flag generator shown in FIG. 11.

If overlapping lines are present in the patterns before and after the cursor movement, no problem is posed in the flag setting and the read sequence described above. However, flag setting can be performed in accordance with a sequence of the flow chart in FIG. 12.

More specifically, when the cursor movement is detected in step S11, a larger one (i.e., the lower line on the display screen) of the source top line address and the destination line address is set in a register $Y_L$, and a smaller one of them is set in a register $Y_S$ in steps S12 and S13. A counter N corresponding to the number of lines of the cursor pattern is reset in step S14. In steps S15, S16, and S17, flags corresponding to the addresses of 64 lines are set from the addresses from the register $Y_S$.

It is determined in step S18 whether an overlapping portion is present in the lines of the source cursor pattern and the destination cursor pattern. If NO in step S18, the counter N is reset in step S19. However, if YES in step S18, a value obtained by subtracting $Y_S$ from $Y_L$ is set in the counter N in step S20. Thereafter, in steps S21, S22, and S23, the flags for addresses of $Y_K$+B, i.e., the flags required for incrementing N to 64, are set.

The flag read & clear circuit 506 reads out the flags set as described above from the flags associated with the addresses of the source cursor pattern and transfers them to the line address generator 7.

Figure 13:
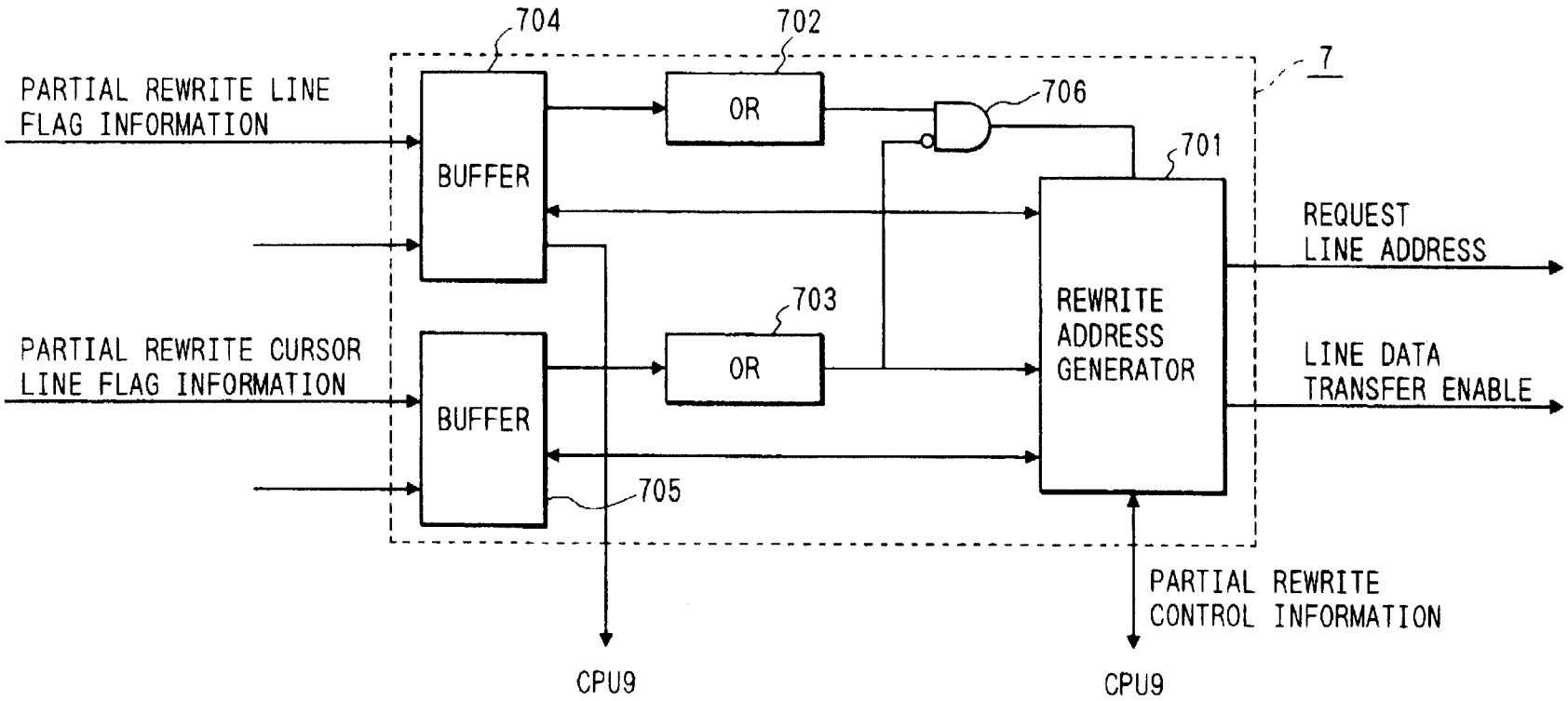
FIG. 13 is a block diagram showing the detailed arrangement of a line address generator shown in FIG. 4B.

FIG. 13 is a detailed block diagram of the line address generator 7.

The partial rewrite flag information and the partial rewrite cursor flag information which are transferred from the rewrite detector/flag generator 5 are stored in buffers 704 and 705, respectively. These pieces of flag information stored in the buffers 704 and 705 are output to a rewrite address generator 701 through corresponding OR circuits 702 and 703 for performing OR operations of all the bits of these buffers. An AND circuit 706 is arranged in a signal path extending from the OR circuit 702 to the rewrite address generator 701.

The AND circuit 706 receives the data from the all-bit OR circuit 702 and the inverted data of the data from the all-bit OR circuit 703. For this reason, the data from the all-bit OR circuit 703, i.e., the partial rewrite cursor line flag information is preferentially input to the rewrite address generator 701. With this arrangement, the partial rewrite operation for the cursor movement is preferentially performed.

As described above, of all the cursor line flag information transferred to the line address generator 7, flag information associated with the line of the source cursor pattern is preferentially transferred over the flag associated with the destination cursor. For this reason, the rewrite address generator 701 requests, to the SVGA 1, display data of a line address of flag information to be transferred next. The SVGA 1 reads out the display data at this line address and sends it as erase data to the FLCD. Therefore, the source cursor pattern is erased.

Figure 14:
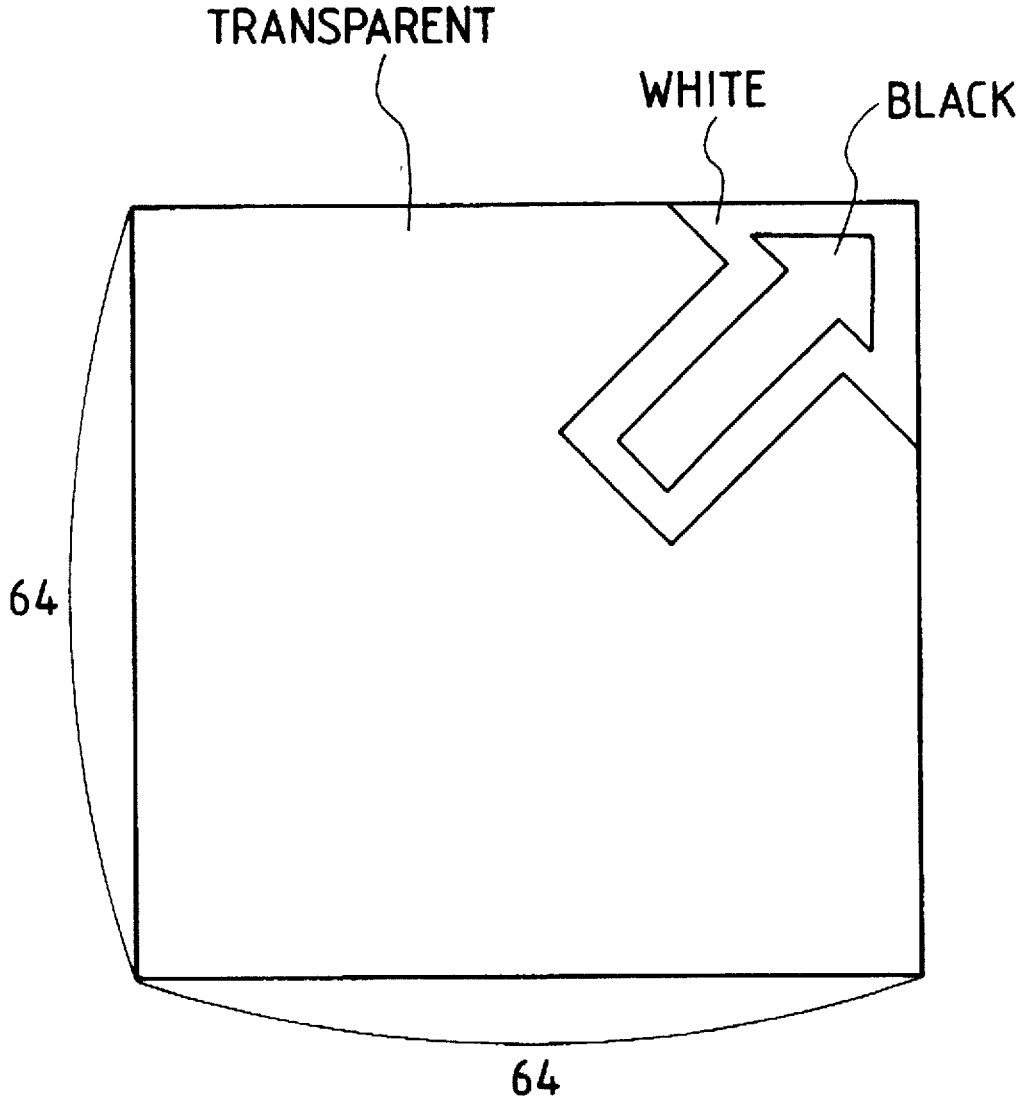
FIG. 14 is a view illustrating a detailed cursor pattern.

The details of the cursor pattern are shown in FIG. 14. In a pattern constituted by 64 lines each consisting of 64 pixels, a white "arrow" surrounds a black "arrow", and the remaining portion is "transparent". In the following modification, a partial rewrite operation can be performed in only the "transparent" portion of the pattern.

Figure 15:
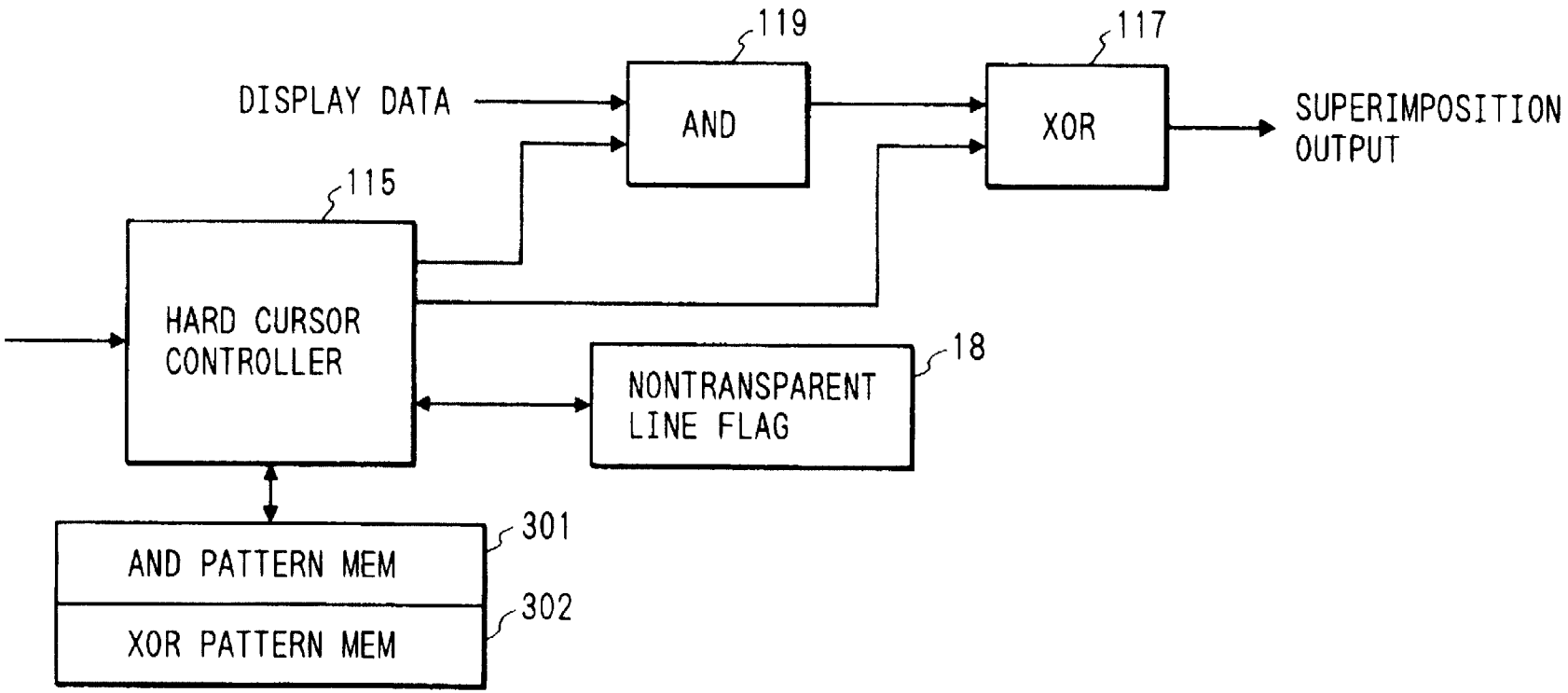
FIG. 15 is a block diagram showing an arrangement for a superimposition output.

FIG. 15 is a block diagram showing the arrangement for superimposing the cursor pattern data shown in FIG. 14 on display data. This arrangement is constituted by the respective circuits described with reference to FIGS. 4 and 5, the hard cursor controller 115, the AND circuit 119, the XOR circuit 117, an AND pattern memory 301, an XOR pattern memory 302, and the nontransparent line flag 18.

Figure 16:
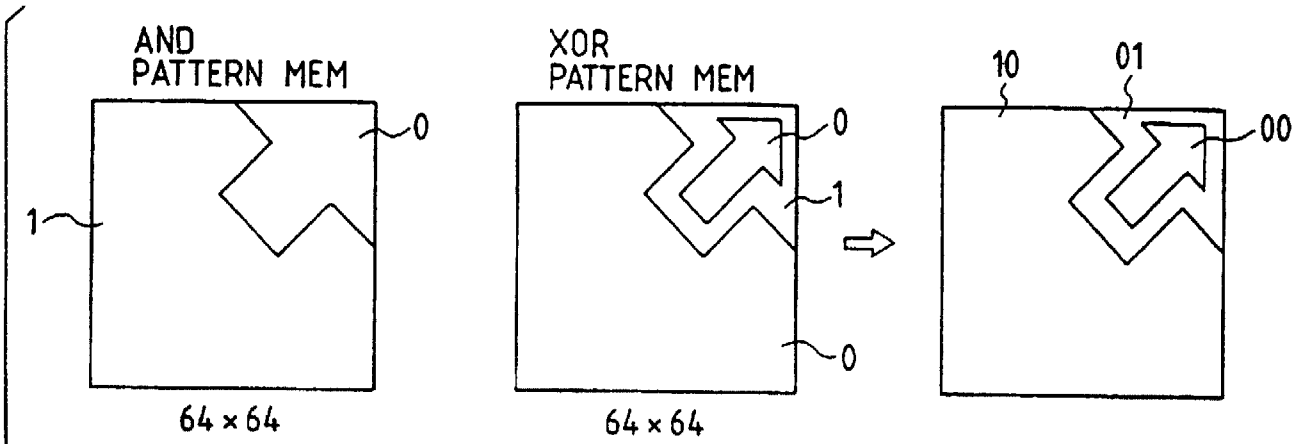
FIG. 16 is a view for explaining a relationship between superimposition and a pattern memory used therein.

"0" or "1" corresponding to each pattern shown in FIG. 16 is written at each address of the AND pattern memory 301 and the XOR pattern memory 302. For example, "0" is written in a portion corresponding to the cursor arrow in the AND pattern memory. The hard cursor controller 115 outputs each content of the AND pattern memory 301 to the AND circuit 119. This output data is logically ANDed with the display data. This AND output is input to the XOR circuit 117 and is logically XORed with each content of the XOR pattern memory 302. As a result, each superimposition output shown in FIG. 16 is obtained. When a "transparent" output is obtained, a display data image is displayed in the "transparent" portion.

In the above cursor pattern, flags corresponding to lines given as nontransparent pixels except for the lines given as "transparent" pixels are set in the nontransparent line flag 18. This flag setting allows to write corresponding data in the AND pattern memory 301 and the XOR pattern memory 302 through the hard cursor controller 115. In this case, a specific line which is entirely "transparent" is detected, and a nontransparent line is detected on the basis of the "transparent" line. The flag of the corresponding line is set. This flag setting process will be described with reference to FIG. 17.

Figure 17:
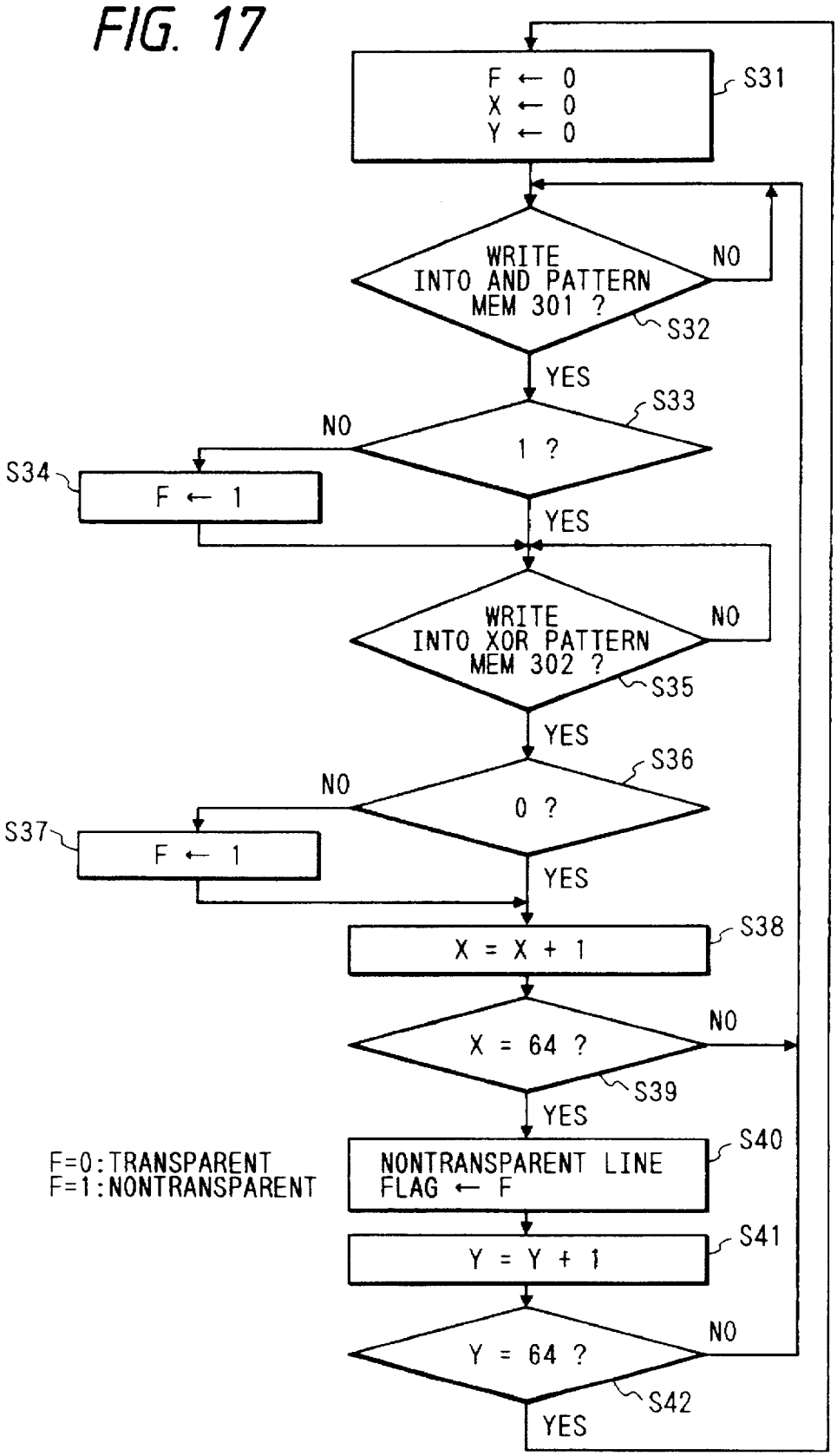
FIG. 17 is a flow chart showing a nontransparent line flag set process of a modification of the first embodiment.

Referring to FIG. 17, initial values are set in a transparent/nontransparent discrimination parameter F and pixel addresses X and Y in the cursor pattern (64×64). In steps S32, S33, and S34, when data which is not set at "1" is to be written in the AND pattern memory 301, the parameter F is set at "1". In steps S35, S36, and S37, when data which is not set at "0" is to be written in the XOR pattern memory 302, the parameter F is set at "1". In steps S38 and S39, the above setting operation is repeated for one line. In step S40, an F value obtained upon operation of one line is defined as the content of the nontransparent line flag. That is, if F is set at "1" even once during the one-line process, the flag is set at "1". This indicates that a nontransparent portion is present in at least part of this line.

Figure 18A:
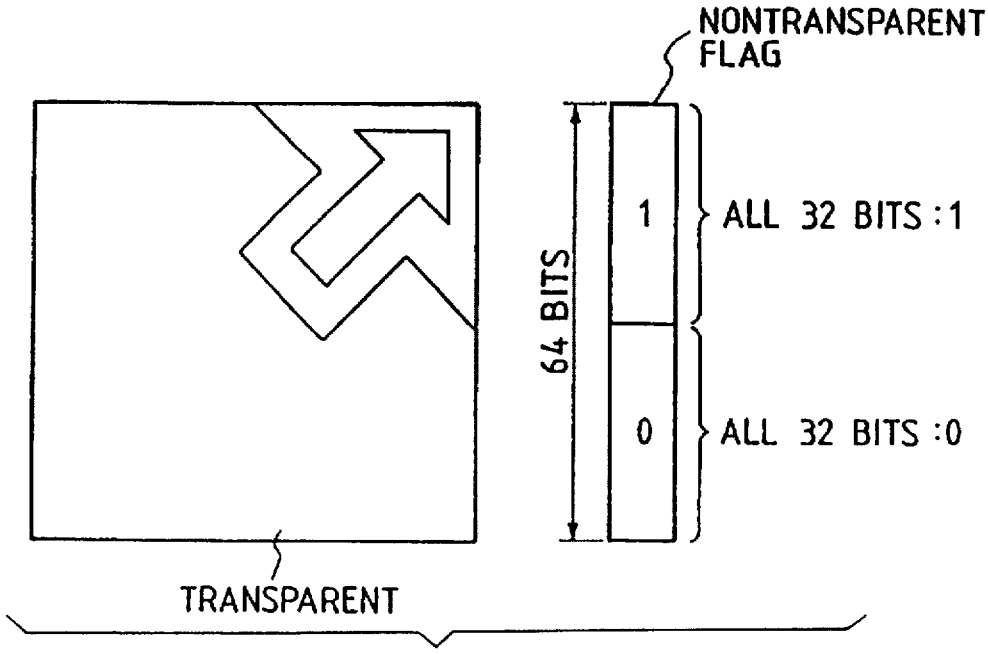
FIGS. 18A and 18B are views illustrating states of flag set in the process shown in FIG. 17.
Figure 18B:
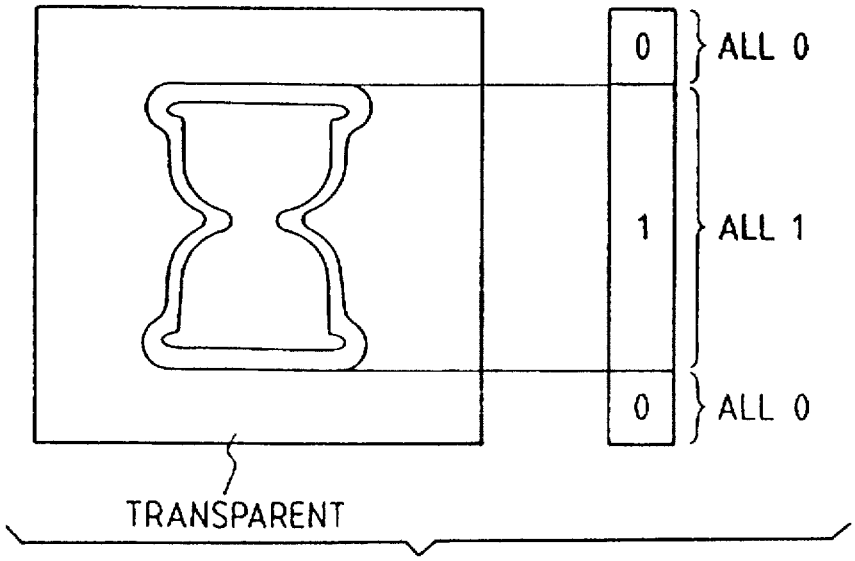

In steps S41 and S42, the above process is repeated for the number of lines (64 lines) to complete a nontransparent flag setting process. FIGS. 18A and 18B show the results of nontransparent flag settings.

The SVGA 1 refers to the transparent line flags obtained as described above and generates the above cursor rewrite line address, thereby setting the flag of the cursor flag register 508 on the basis of the resultant cursor rewrite line address.

As another example, two partial rewrite operations may be combined. That is, only the flag of the top line address of the cursor pattern may be set, and the line address generator 7 may generate a rewrite request address with reference to the nontransparent line flag on the basis of the set flag.

Second Embodiment

Another embodiment for preferentially performing a partial rewrite operation for a cursor movement will be described below.

Figure 19:
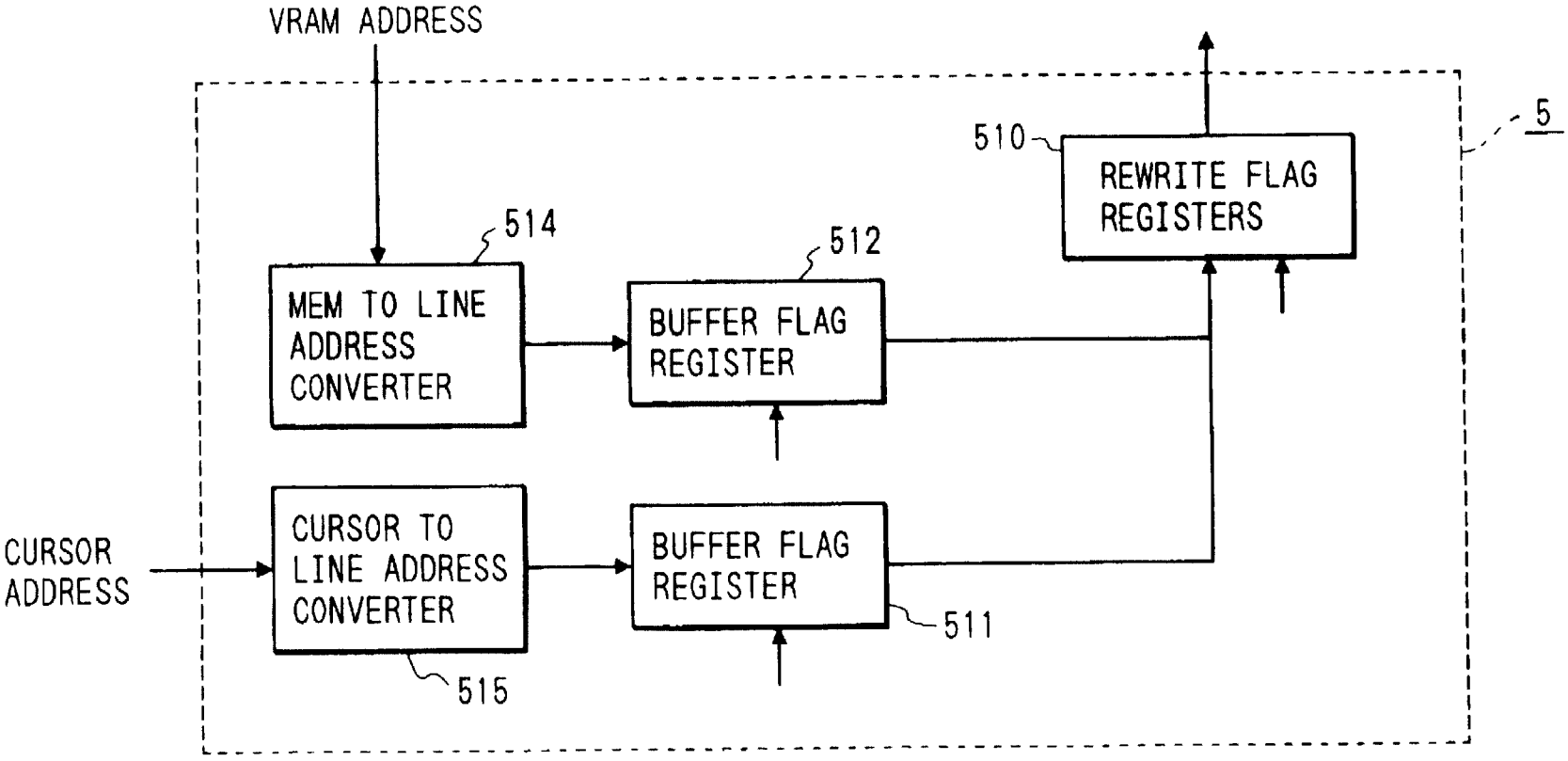
FIG. 19 is a block diagram showing a rewrite detector/flag generator according to the second embodiment of the present invention.

FIG. 19 is a detailed block diagram of a rewrite detector/flag generator 5 (FIG. 4A) of this embodiment.

An address accessed for a VRAM 3 by an SVGA 1 (FIG. 4A) to perform a rewrite operation is stored in a buffer flag register 512 through a memory to line address converter 514. A cursor address from a CPU 9 is stored in a buffer flag register 511 through a cursor to line address generator 515. The pieces of flag information stored in the buffer flag registers 511 and 512 are rewritten into the form of serial signals (to be described later), and the serial signals are transferred to rewrite flag registers 510.

Figure 20:
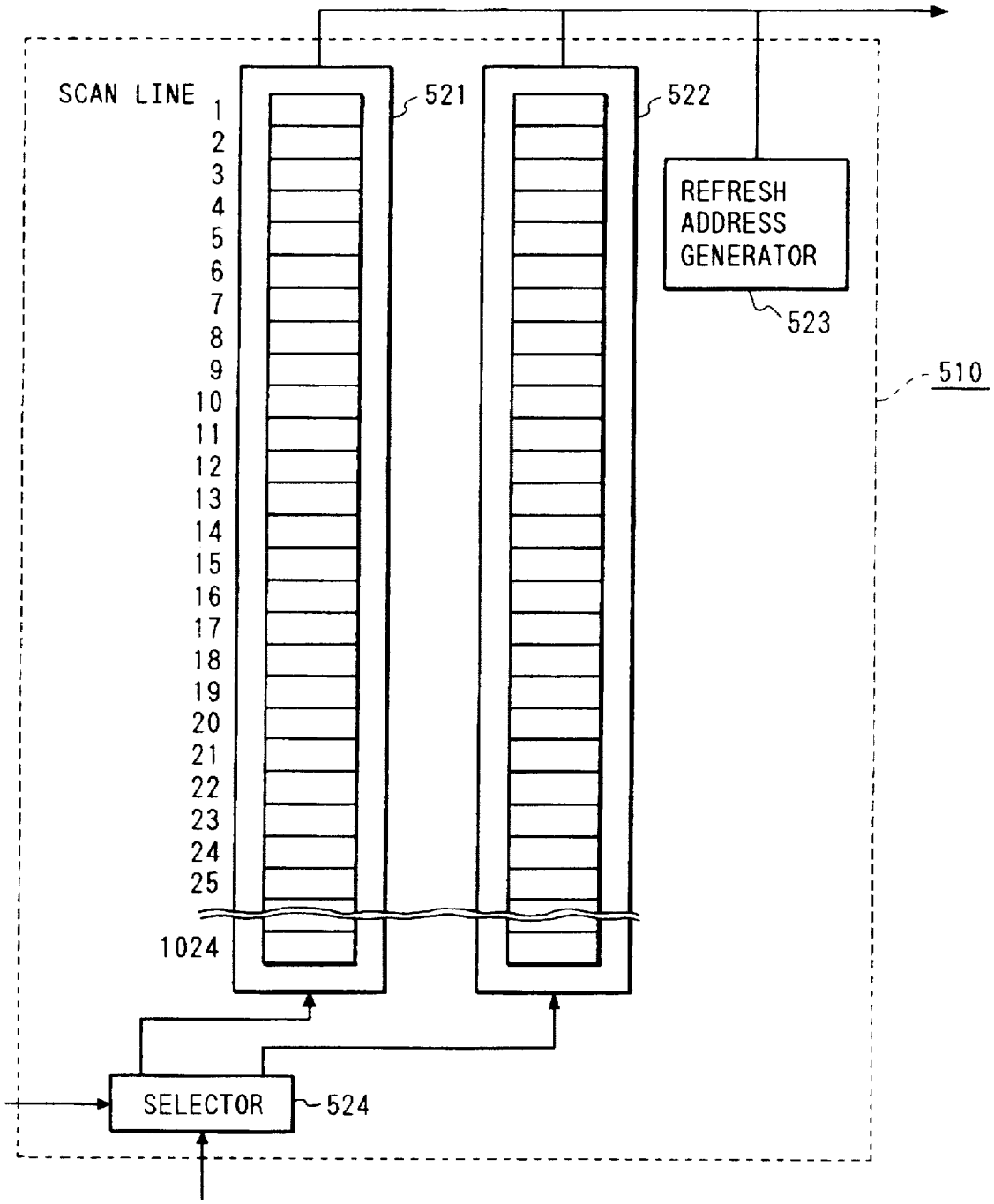
FIG. 20 is a block diagram showing the detailed arrangement of rewrite flag registers shown in FIG. 19.

FIG. 20 is a block diagram showing the detailed arrangement of the rewrite flag registers 510.

The rewrite flag registers 510 include a rewrite flag register 521 associated with a partial rewrite operation for cursor display, a rewrite flag register 522 associated with a partial rewrite operation for accessing the VRAM, and a refresh address generator 523. The flag information of the buffer flag register 511 is set in the rewrite flag register 521, and the flag information of the buffer flag register 512 is set in the rewrite flag register 522. A selector 524 appropriately sorts the pieces of serially transferred flag information and stores them in the corresponding registers.

Figure 21:
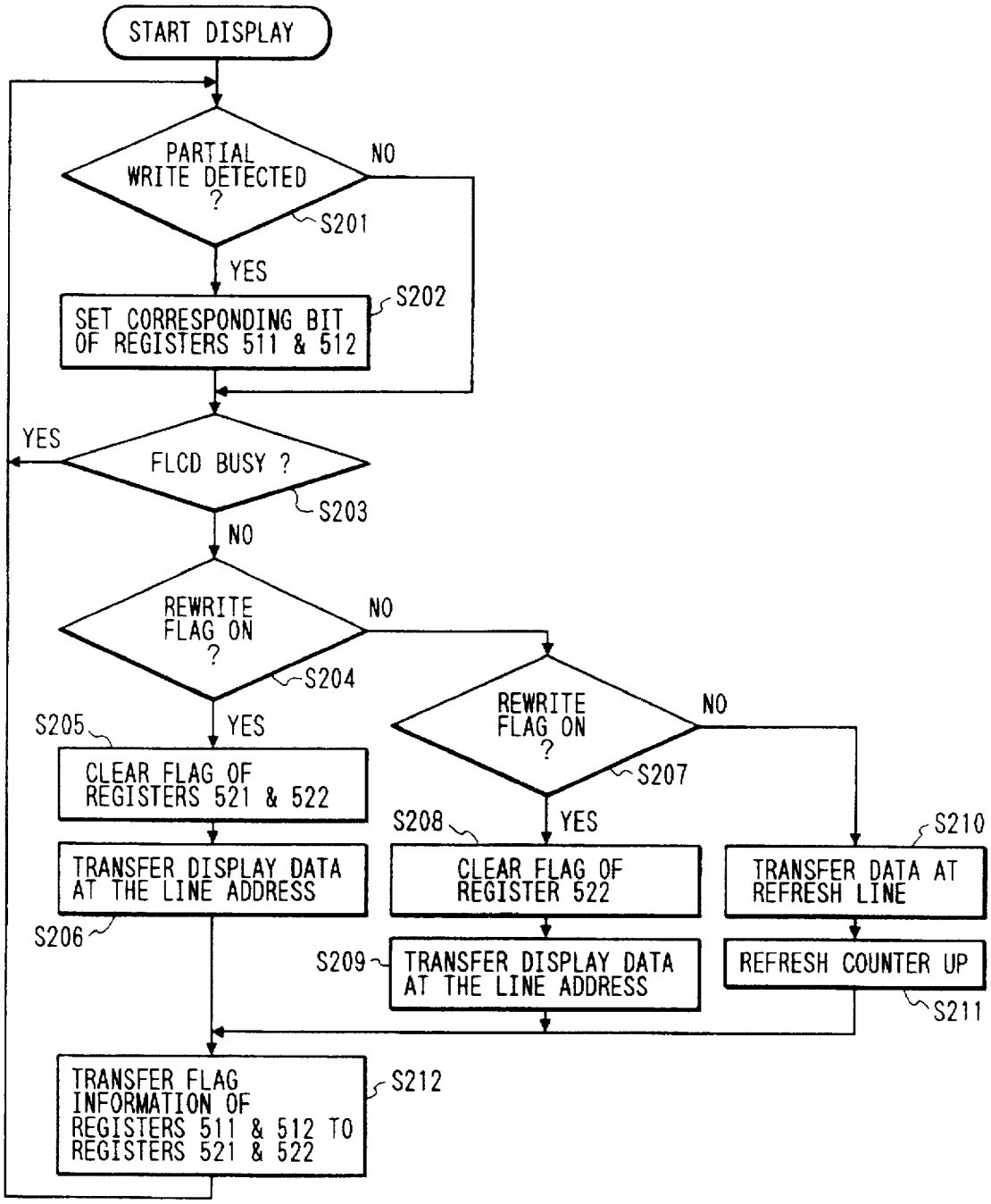
FIG. 21 is a flow chart showing the flow of a display control process according to the second embodiment.

FIG. 21 is a flow chart showing a display control sequence of this embodiment.

In step S201, when the cursor or normal write operation is detected in the VRAM 3, the flag is set in the corresponding bit of the buffer flag register 511 (cursor) or 512 (VRAM) in accordance with the detected cursor or write operation. When a Busy signal from an FLCD 20 is released in step S203, the cursor display rewrite flag register 521 is scanned in step S204 to determine whether a bit having a flag of "1" is present.

If YES in step S204, to preferentially display this line address, the flags of the rewrite flag registers 521 and 522 which correspond to this line are cleared. At the same time, the display data of this line address is transferred to cause the FLCD 20 to perform the display in step S206.

If no set flag is present in the rewrite flag register 521, it is determined whether a flag set in the rewrite flag register 522 is present. If the flag set in the rewrite flag register 522 is detected, a display operation is performed in steps S208 and S209. Otherwise, a refresh display operation is performed in steps S210 and S211.

When one of the three modes described above is completed, the pieces of flag information in the buffer flag registers 511 and 512 are transferred to the rewrite flag registers 521 and 522 in step S212.

Figure 22A:
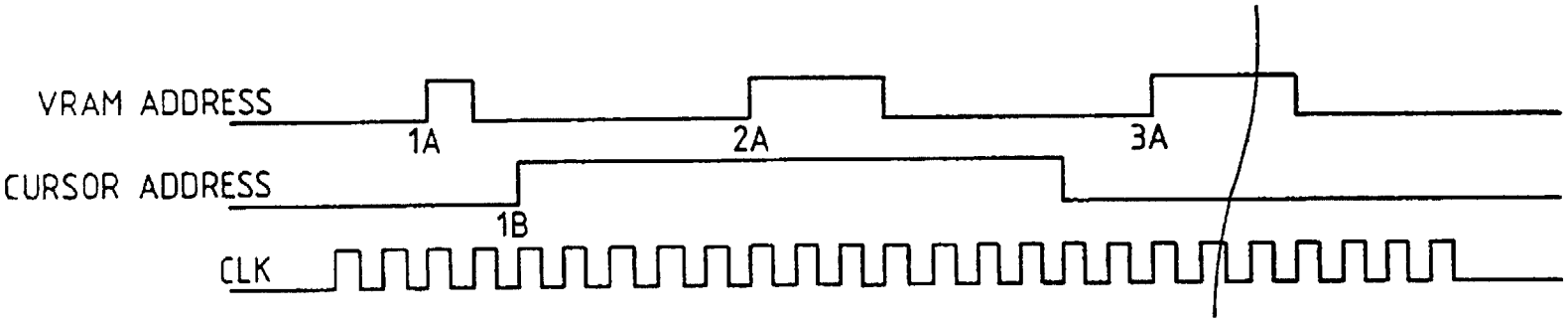
FIGS. 22A and 22B are timing charts of data settings and data transfer in the above process.
Figure 22B:
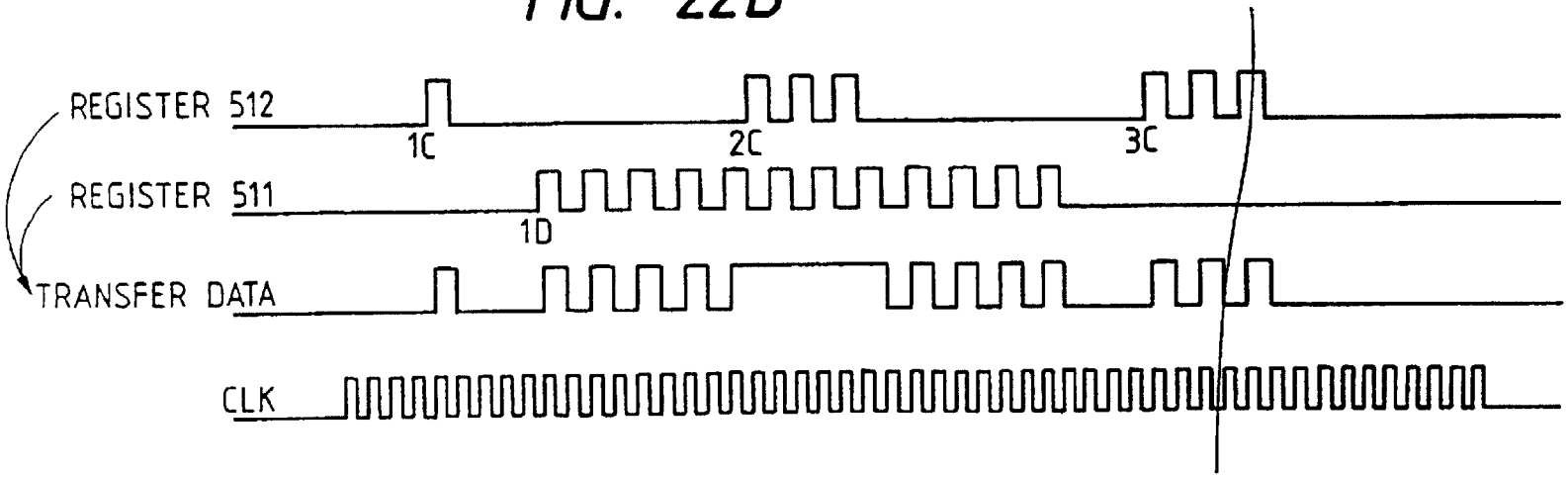

FIGS. 22A and 22B are timing charts showing VRAM and cursor addresses transferred to the rewrite detector/flag generator 5, settings of flags in the buffer flag registers 512 and 511 in correspondence with these addresses, and transfer of flag information of the registers 512 and 511.

In response to flag settings of the VRAM addresses at time 1A, time 2A, and time 3A in FIG. 22A, the corresponding flags of the buffer flag register 512 are set at time 1C, time 2C, and time 3C in FIG. 22B. Similarly, the address transferred at time 1B is set in the buffer flag register 511 at time 1D.

The pieces of flag information set in the buffer flag registers 511 and 512 are transferred to the rewrite flag registers 521 and 522, respectively, in the form of transfer data shown in FIG. 22. That is, the data in the respective buffer flag registers are serially transferred while being shifted by a ½ wavelength.

As a result, the contents of the rewrite flag registers 521 and 522 before the transfer of the buffer flag information shown in FIG. 23 are changed to the contents shown in FIG. 24 upon the transfer.

As can be apparent from the above description, according to the present invention, the partial rewrite operation of a specific pattern, such as cursor movement, can be preferentially performed.

The volume of the specific pattern rewrite information can be reduced, and the rewrite operation can be performed at high speed.

As a result, a partial rewrite operation (e.g., a cursor movement) at a relatively high speed can be properly performed.

Third Embodiment

Figure 25:
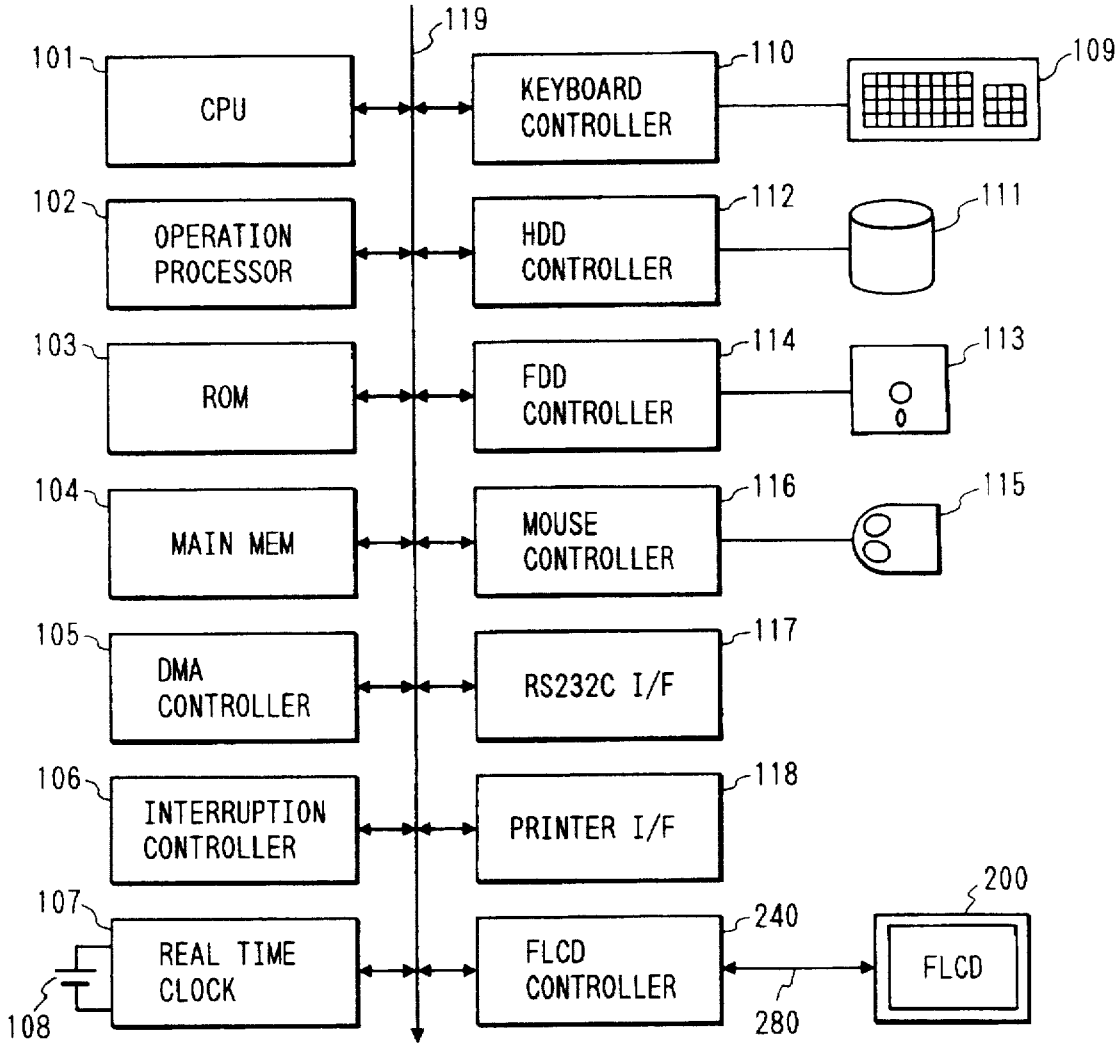
FIG. 25 is a block diagram of an information processing system having a display control apparatus according to the third embodiment of the present invention.

FIG. 25 is a block diagram showing an information processing system having a display control apparatus according to the third embodiment of the present invention.

Referring to FIG. 25, a CPU 101 controls the overall information processing system.

An operation processor 102 supports the operations of the CPU 101 at high speed.

A ROM 103 stores programs for realizing the basic control functions of the CPU 101.

A main memory 104 stores programs executed by the CPU 101 and is used as a work area during execution of the programs. The main memory 104 is also used as a memory for performing an image data process and serves as a virtual display screen memory.

A DMA controller (Direct Memory Access Controller; to be referred to as a DMAC hereinafter) 105 transfers data between the main memory 104 and a VRAM (to be described later) without control of the CPU 101 and between the respective components of this system and the memories, i.e., the main memory 104 and the VRAM.

An interrupt controller 106 controls a hardware interrupt request generated by each component constituting this system.

A real time clock 107 has a calendar function and a timepiece function and includes a C-MOS RAM for storing nonvolatile information.

A backup lithium battery 108 operates the real time clock 17 in the power-OFF state of the system.

A keyboard 109 is used to input character information of various characters and control information.

A keyboard controller 110 controls the keyboard 109.

A hard disk device 111 serves as an external memory device.

An HDD (Hard Disk Drive) controller 112 transfers data between the hard disk device 111 and this system and performs any other control.

A floppy disk device 113 serves as another external memory device.

An FDD (Floppy Disk Drive) controller 114 performs data transfer between the floppy disk device 113 and this system and performs any other control.

A mouse 115 serves as a pointing device.

A mouse controller 116 connects signals between the mouse 115 and this system.

An RS232C I/F 117 connects an external input/output device having an RS232C I/F.

A printer I/F 118 connects an external printer or any other external device.

A display unit (to be referred to as an FLCD) 200 has a signal processing circuit serving as an interface between an FLCD controller to be described later and the display screen having a ferroelectric liquid crystal as a display medium.

An FLCD controller 240 has an interface with the FLCD 200 of this embodiment.

A display I/F 280 interfaces the FLCD 200 and the FLCD controller 240.

A system bus 119 comprises a data bus, a control bus, and an address bus to connect signals between the respective components of the system.

Figure 26:
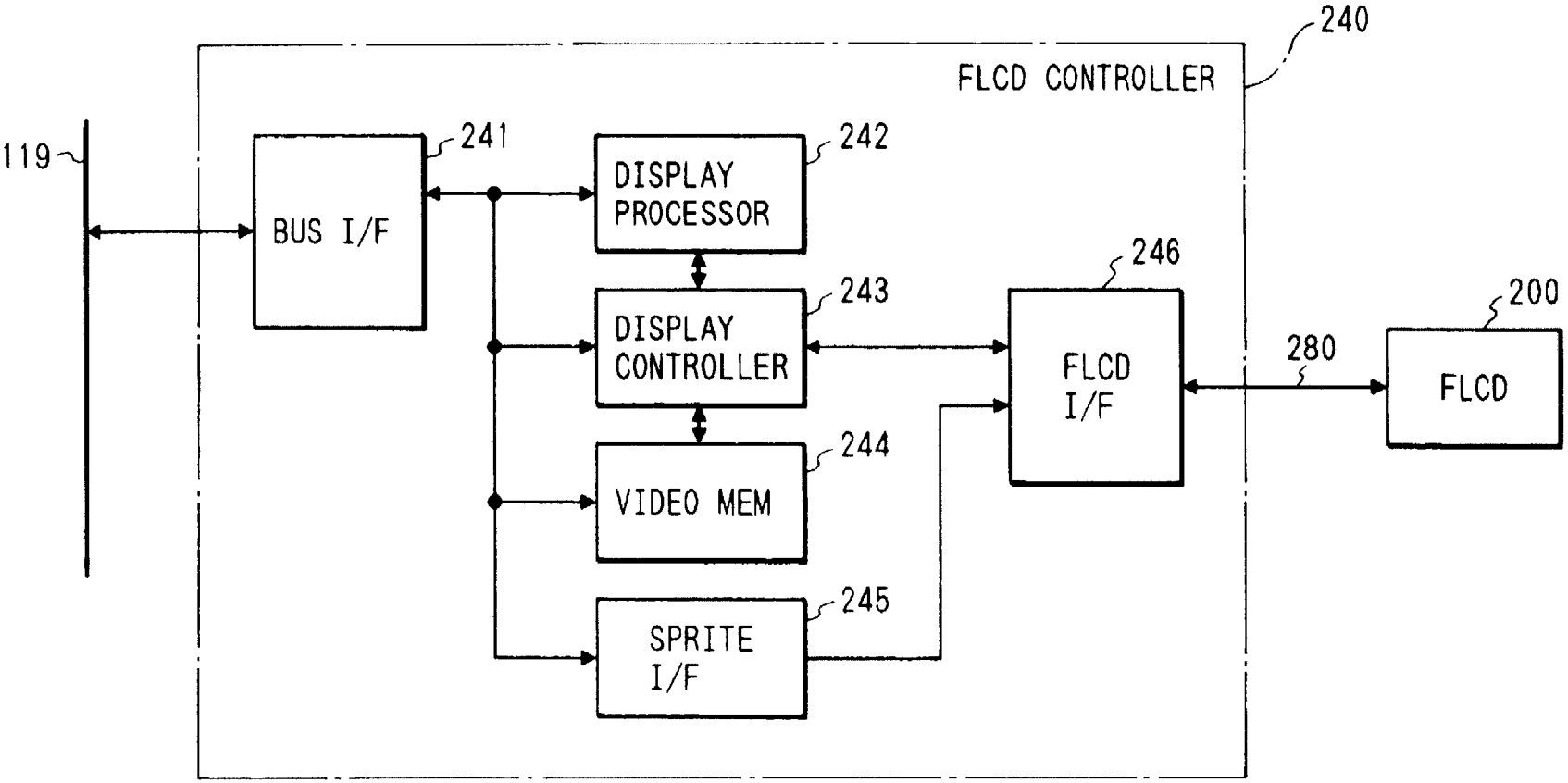
FIG. 26 is a detailed block diagram of an FLCD controller according to the third embodiment of the present invention.

FIG. 26 is a detailed block diagram of the FLCD controller 240.

A bus I/F 241 includes a buffer, a driver, an address decoder, and other circuits to connect the internal circuit of the FLCD controller 240 and the data, control, and address buses of the system bus 119.

A display processor 242 analyzes, processes, and operates commands and data which are sent from the CPU 101 and devices connected to the system bus 119, sends a control signal to a display controller (to be described later). The display processor 242 analyzes, processes, or operates data from a video memory to be described later and stores the generated display data in the video memory.

A display controller 243 generates various display timing signals under the control of the display processor 242 or the CPU 101, stores display data from the system bus 119 or the display processor 242 in the video memory, and refreshes a DRAM element in the video memory.

The display controller 243 reads out display data from the video memory together with the control signal or directly processes and outputs the display data.

A video memory 244 can be read/write-accessed by the display processor 242, the display controller 243, the CPU 101, and various devices connected to the system bus 119.

A sprite I/F 245 supplies sprite information from the mouse 115 to the display processor 242, the display controller 243, the CPU 101, or each device connected to the system bus 119. The sprite I/F 245 converts the input information into a format required for an FLCD I/F (to be described below).

An FLCD I/F 246 performs conversion into the format required for the FLCD 200 on the basis of the display data and the control signal from the display controller 243 and the sprite information from the sprite I/F 245.

Figure 27:
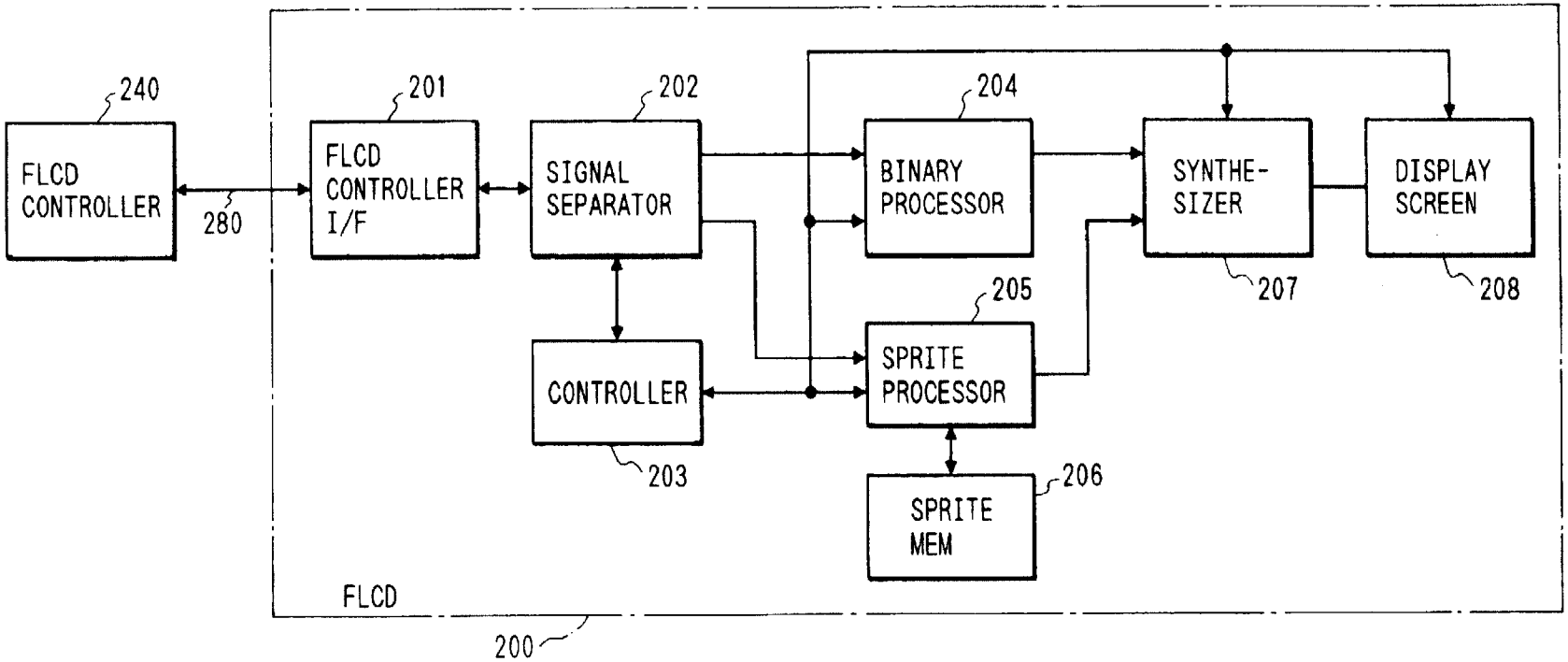
FIG. 27 is a detailed block diagram of an FLCD according to the third embodiment of the present invention.

FIG. 27 is a detailed block diagram of the FLCD 200.

Referring to FIG. 27, an FLCD controller I/F 201 exchanges signals with the FLCD controller 240.

A signal separator 202 receives data from the FLCD controller 240 and the data through the FLCD controller I/F 201, separates the input data in accordance with functions, and transfers data generated by the FLCD 200 and sent to the FLCD controller 240 to the FLCD controller interface 201.

Of the data separated by the signal separator 202, data associated with control is received by a controller 203. The controller 203 controls all the functions in the FLCD 200.

A binary processor 204 performs a binary process such as error diffusion or dithering of the display data of the data separated by the signal separator 202. The binary processor 204 performs or does not perform a binary process under the control of the controller 203. When the binary process is not performed, the binary processor 204 has a function of converting input data into data matching the number of display colors of a display screen (to be described later).

A sprite processor 205 receives sprite data of the data separated by the signal separator 202, stores the sprite pattern in a sprite memory (to be described later), reads out a sprite pattern from the sprite memory as needed, and sends the readout data to a synthesizer (to be described later). The sprite processor 205 read/write-accesses the sprite memory under the control of the controller 203. If a plurality of sprite patterns are present, the sprite processor 205 selects a sprite pattern.

A sprite memory 206 read/write-accessed under the control of the sprite processor 205. The sprite memory 206 can store one or a plurality of sprite patterns. In addition, the sprite memory 206 can store other necessary control data.

A synthesizer 207 synthesizes the display data from the binary processor 204 and the sprite data from the sprite processor 205 at a desired timing in accordance with a desired logic and sends the synthesized data to a display screen (to be described later). The synthesizing timing, the logic, and any other necessary control are determined by the controller 203.

A display screen 208 is a visual output means and is constituted by a display device and a display driver. The display data is supplied from the synthesizer 207, and the control signals such as the timing signal are supplied from the controller 203.

Figure 28:
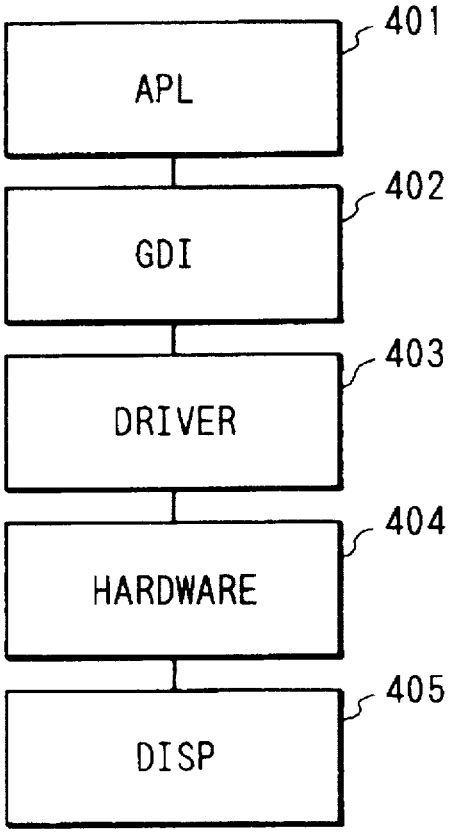
FIG. 28 is a view showing the concept of the control structure of a display device according to the third embodiment of the present invention.

FIG. 28 is a view showing the concept of the control structure of the display device.

An application program (APL) 40 is operated in the information processing system.

A graphic display I/F (GDI) is the one in, e.g., the WINDOWS available from MICROSOFT.

A device driver 403 is configured between the APL 401 and the GDI 402.

Hardware 404 does not include an FLCD to be described below.

A display (DISP) 405 represents part or all of the display screen of the FLCD 200.

In a general information processing system, the APL 401 is programmed not depending on the hardware 404 in view of cost and resources. In this case, differences in the hardware 404 can be absorbed (or interfaced) by the device driver 403. In control of the graphic screen, the APL 401 is expressed in a maximum program representation so as not to cause the number of colors to depend on the hardware 404.

This is a general method in consideration of compatibility and further expansion of the hardware 404.

Assume that the maximum number of colors used in the APL 401 is about 16.7 millions. This number of colors can be expressed as a total of 24 bits, i.e., eight bits for each of red (to be referred to R hereinafter), green (to be referred to as G hereinafter), and blue (to be referred to as B hereinafter).

Figure 29:
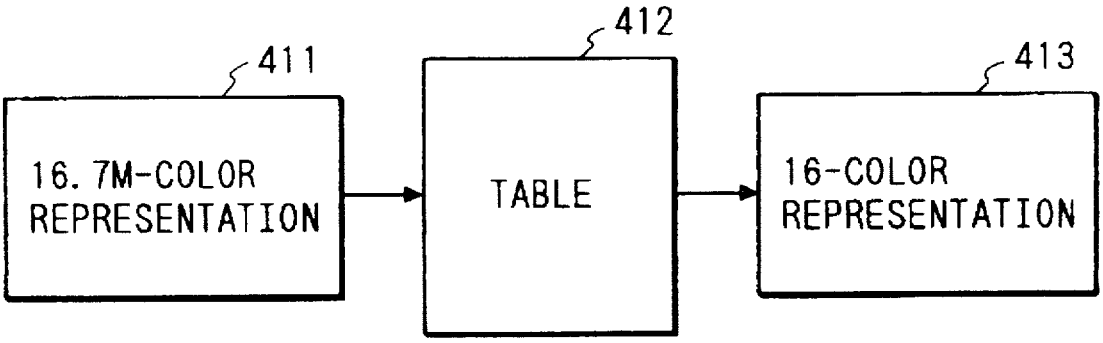
FIG. 29 is a view showing conversion of a color representation using a table according to the third embodiment of the present invention.
Figure 30:
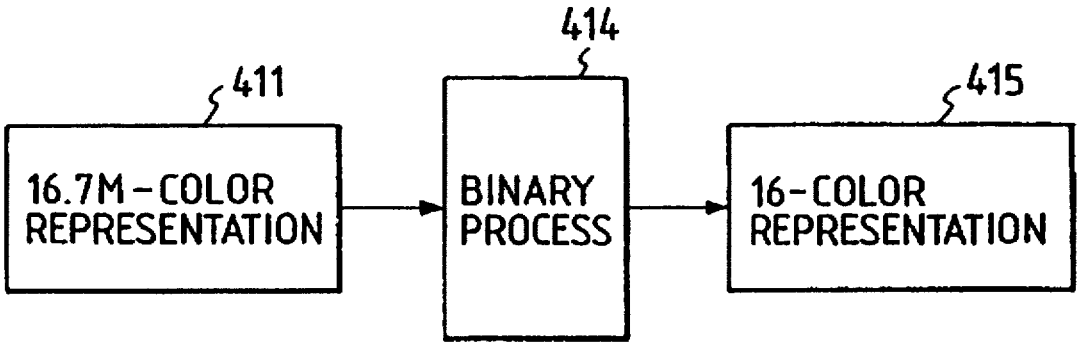
FIG. 30 is a view showing conversion of a color representation using a binary process according to the third embodiment of the present invention.

In this case, if the color display capacity of the display 405 is a 16-color representation, the 16.7M-color representation must be converted into the 16-color representation. In the device driver 403 or the hardware 404, a general method is a method of simply converting (rounding) a 16.7M-color representation 411 into a 16-color representation 413 (FIG. 29) or a method of performing a binary process 414 such as an error diffusion method, an ED method, or a dither method to obtain a binary 16-color representation 415 (FIG. 30).

The former method is advantageous for characters, and the latter method is advantageous for gradation materials such as a photograph and a picture in view of the final image quality.

When the former method, the latter method, or a method as a combination of the former and latter methods is selectively used, various methods are proposed to discriminate, separate, switch image information, and a detailed description thereof will be omitted.

Referring to FIG. 28, assume that the APL 401 is expressed as the 16.7M-color representation, that the display 405 has a 16-color representation capacity, and that the APL 401 processes multi-color objects such as a photograph or picture, a binary process can be performed by any one of the APL 401, the GDI 402, the device driver 403, the hardware 404, and the display 405.

When this binary process is performed by the display 405, information representing whether an object can be subjected to the binary process is supplied from the hardware 404 as area separation information or is determined in accordance with the content of the image data in the display 405.

The former can receive information from a higher level such as the device driver 403 and can be easily achieved.

The latter is relatively difficult because high-speed image data must be processed in real time.

In either method, the edge of a sprite such as an arrow-like cursor used as a means for designating a visual position on the display screen is not emphasized and cannot be easily recognized due to high-speed movement on the screen if the sprite information is binarized without being separated from any other information. When the sprite pattern or its neighboring portion upon movement of the sprite are binarized different from the expected effect image, the quality of a picture or the like is degraded.

The sprite pattern content is directly written in the video memory 244, and two sprite pattern display methods are available. First, the sprite is represented by scanning the entire display screen. Second, a memory is provided in a separate area, a sprite pattern is written in the memory in advance, and a specific screen position at which the sprite pattern is displayed is set using the display controller 243 and the like. The sprite pattern is read out from the memory at a desired timing in a hardware manner. The display content read out from the video memory is superimposed with the sprite pattern, and the superimposition output is sent to the display device 200 under the control of the display controller 240.

The latter method is more popular than the former because a sprite pattern can be moved at high speed.

Referring to FIG. 26, the function of the sprite I/F 245 is not to have a memory for the above sprite pattern, but to send information in a necessary format to the display I/F 246 when the sprite I/F 245 receives the sprite pattern, its display position, and the logic of synthesis with the video output, which are set by the display processor 242, the display controller 243, the CPU 101, and each device connected to the system bus 119.

The FLCD I/F 246 multiplexes image data from the display controller or modulates this information in the initial format on the same signal line and outputs the resultant data to the FLCD 200.

The display controller I/F 201 separates various data in accordance with the above forms or modes described above. The data associated with the display data is then sent to the binary processor 204. Control data is transferred to the controller 203 in accordance with information associated with sprite display. In addition, data associated with the sprite display is transferred to the sprite processor 205.

The sprite processor 205 stores a sprite pattern contained in the received data associated with the sprite display in the sprite memory 206.

Figure 31:
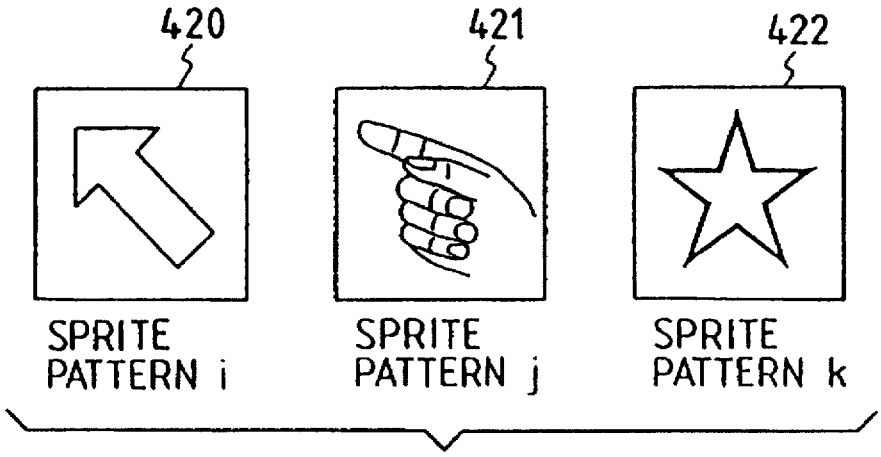
FIG. 31 is a view showing sprite patterns.

For example, a plurality of sprite patterns 420, 421, and 422 are present, as shown in FIG. 31. Even if these sprite patterns are selectively used, all these sprite patterns can be stored or the most frequently used sprite patterns can be selectively stored.

Figure 32:
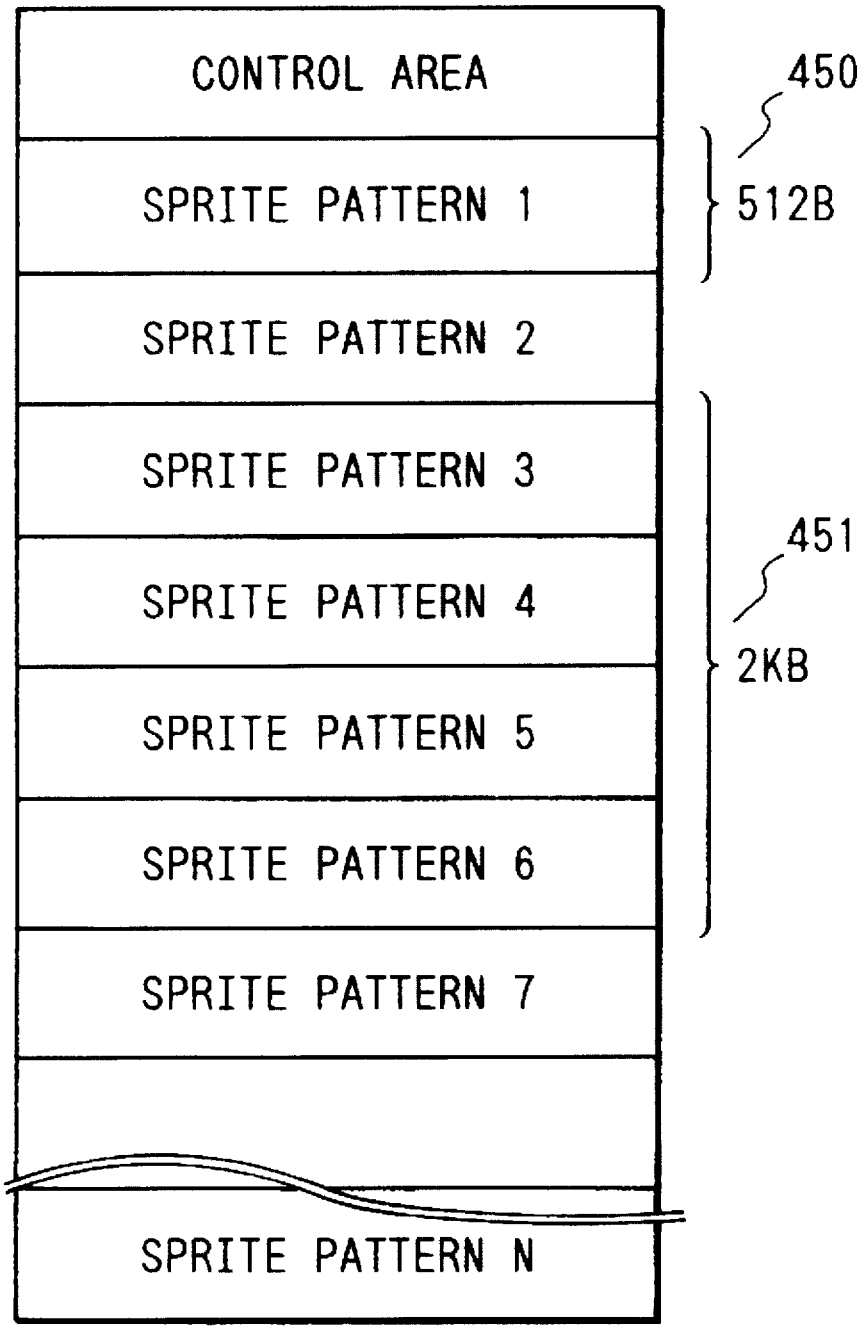
FIG. 32 is a view showing the concept of a storage state of a sprite memory.

FIG. 32 is a view showing the concept of storage contents of the sprite memory 206. Referring to FIG. 32, an area which can store a plurality of sprite patterns can be assured in the sprite memory 206.

Sprite patterns having a plurality of sizes can be stored in the sprite memory 206. For example, if the size of a sprite pattern is 64×64 bits, the sprite data is 512-byte data; and if, 128×128 bits, 2-Kbyte data. The sprite memory 206 has dedicated different capacities. However, the above data can be stored as data 450 and 451, respectively.

In this case, the number and sizes of sprite patterns are managed by the controller 203.

If a work memory is required for this operation, part of the sprite memory 206 is used as a control area under the control of the controller 203. In this manner, the sprite memory 206 can be used for a purpose except for storage of the sprite patterns.

When a sprite pattern is to be displayed, the sprite processor 205 reads out a desired sprite pattern from the sprite memory 206 at a desired timing under the control of the controller 203 in the normal operation and sends the readout sprite pattern to the synthesizer 207.

The synthesizer 207 synthesizes this sprite pattern and the data sent from the binary processor 204.

In this case, the synthesizing logic is supplied from the controller 203 directly or through the sprite processor 205.

The synthesized data is sent as the final display data to the display screen 208.

Figure 33:
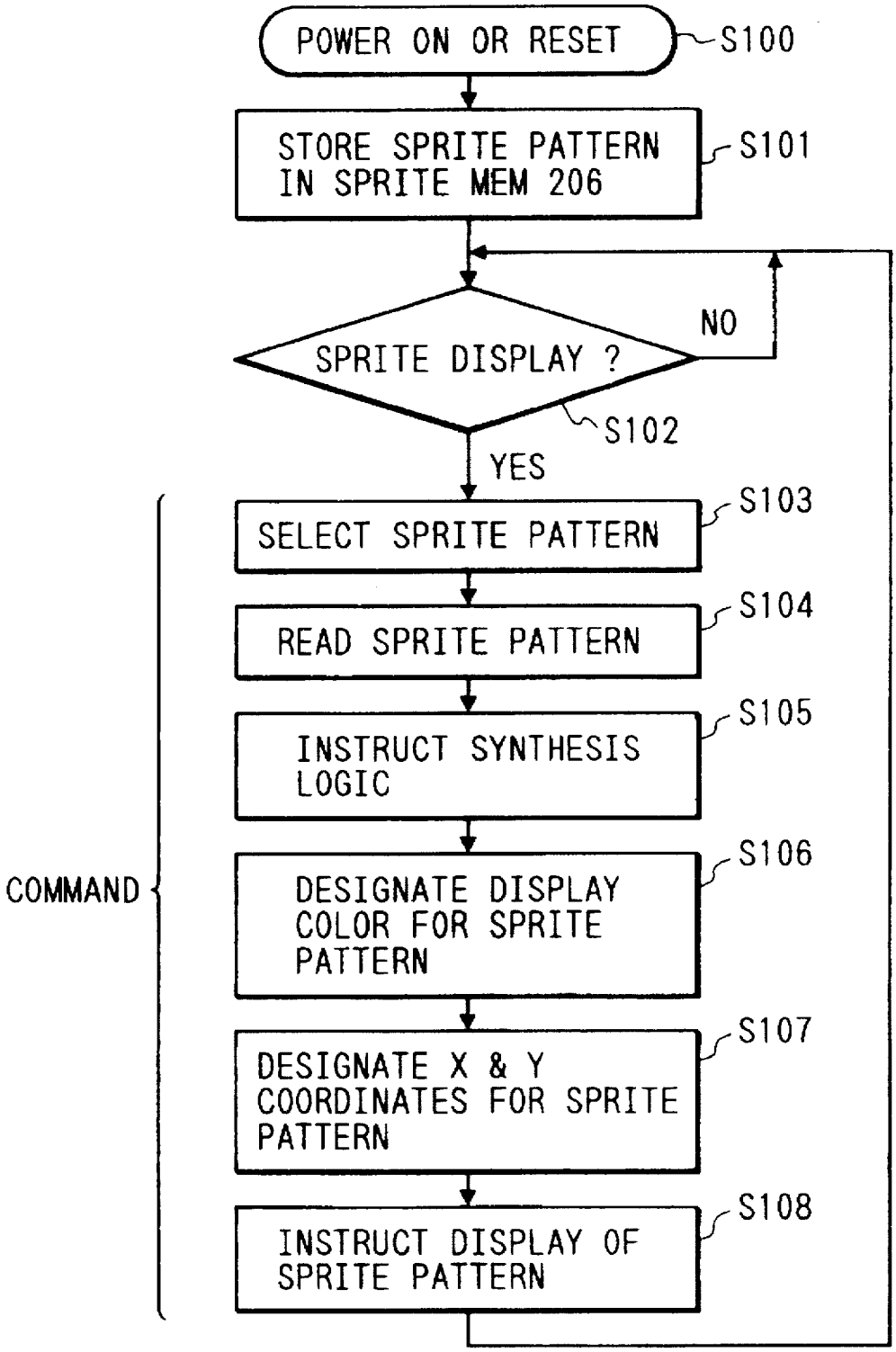
FIG. 33 is a flow chart showing a process according to the third embodiment of the present invention.

FIG. 33 is a flow chart showing a sequence associated with sprite information of all the signals supplied from the display controller 240 to the FLCD 200.

Referring to FIG. 33, a sprite pattern is stored (S101) in the sprite memory 206 in the power-ON or resetting operation (S100). A sprite display is requested (S102), the following operations are performed. The sprite pattern is selected (S103). The sprite pattern is read (S104). The synthesis logic is instructed (S105). The display color for the sprite pattern is designated (S106). The X and Y coordinates for the sprite pattern are designated (S107). A sprite pattern instruction (S108) is separated by the signal separator 202. A command is sent to the controller 203 to shift control to the controller 203.

Figure 34:
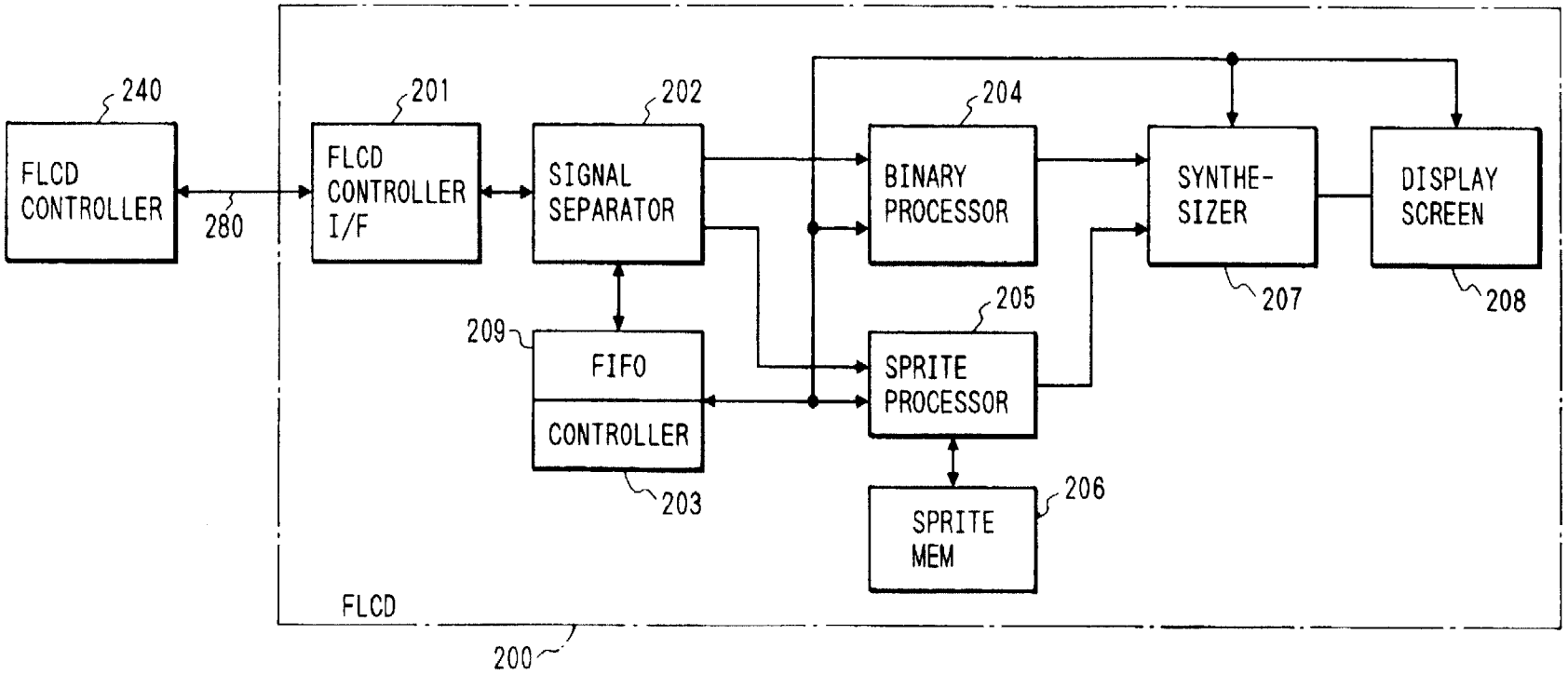
FIG. 34 is a block diagram using an FIFO in the FLCD according to the third embodiment of the present invention.

When the command decoding and executing speeds in the controller 203 are much lower than the transfer speed in the display I/F 280, or the display I/F 280 has a function of returning an ACK signal (or a ready signal) to the display controller 240 upon reception of each command, a FIFO 209 is connected to the input of the controller 203 to smoothly perform transfer and execution, as shown in FIG. 34.

Fourth Embodiment

The fourth embodiment of the present invention will be described below.

Figure 35:
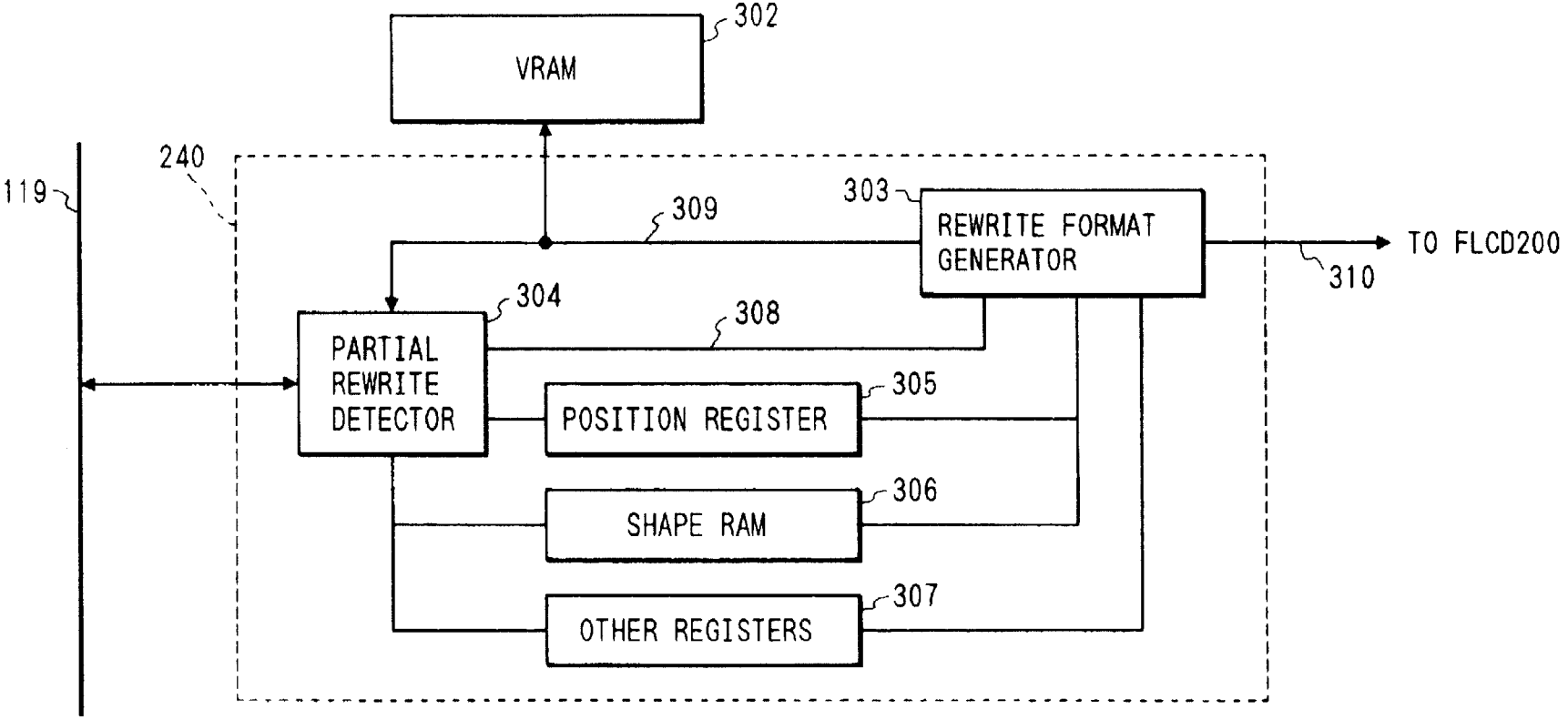
FIG. 35 is a detailed block diagram of an FLCD controller according to the fourth embodiment of the present invention.

FIG. 35 is a detailed block diagram of an FLCD controller 240. Referring to FIG. 35, a VRAM 302 stores image information. A rewrite format generator 303 outputs a partial rewrite address and partial rewrite data to an FLCD 200 and instructs an interface rewrite or partial rewrite operation. An information signal line 310 sends information output from the rewrite format generator 303 to the FLCD 200. A position register 305 represents the position of a hardware cursor on a display screen. A shape RAM 306 stores a hardware cursor shape. A partial rewrite detector 304 detects that data is written in the VRAM 302, the position register 305, or other registers 307 through a computer bus 119. Signal lines 308 and 309 are connected between the partial rewrite detector 304 and the rewrite format generator 303.

When information is written in the VRAM 302, the position register 305, the shape RAM 306, and other registers 307 through the computer bus 119, this is detected by the partial rewrite detector 304 and informs this to the rewrite format generator 303 through the signal line 308. In response to this information, the rewrite format generator 303 outputs data to the FLCD 200 through a signal line 310 in accordance with the rewritten data.

Figure 36:
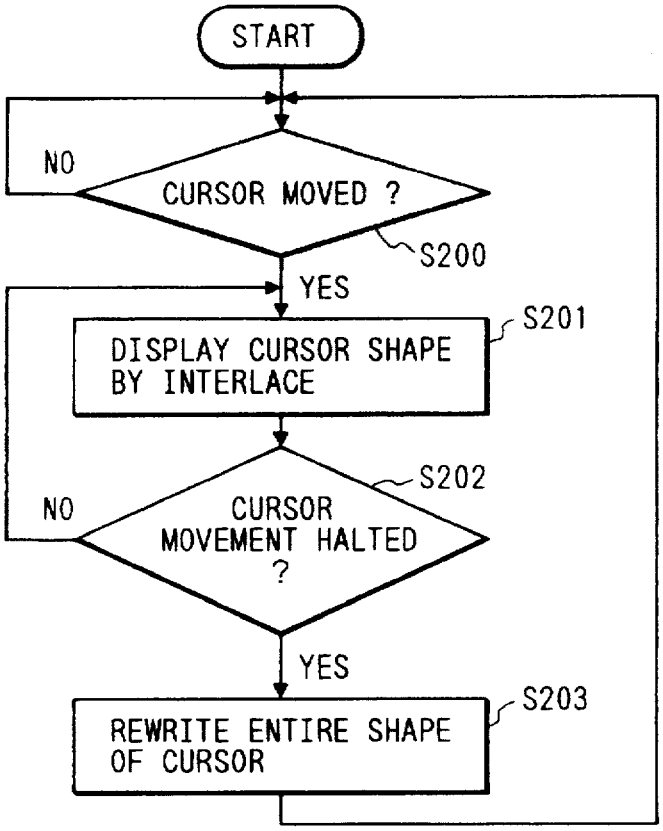
FIG. 36 is a flow chart showing a process according to the fourth embodiment of the present invention.

FIG. 36 is a flow chart showing a sequence for moving a hardware cursor in the FLCD controller 240. In this flow chart, the cursor movement is detected by rewriting the position register 305. The data output to the FLCD 200 is performed by the rewrite format generator 304. That is, the movement/halt of the cursor can be detected to determine whether the position register 305 is rewritten (S200).

When the cursor is moved, the cursor is displayed by interface driving on the basis of the information in the position register 305 (S201). It is then determined whether the cursor movement is halted (S202). If YES in step S202, the entire shape of the cursor is displayed (S203).

Figure 37:
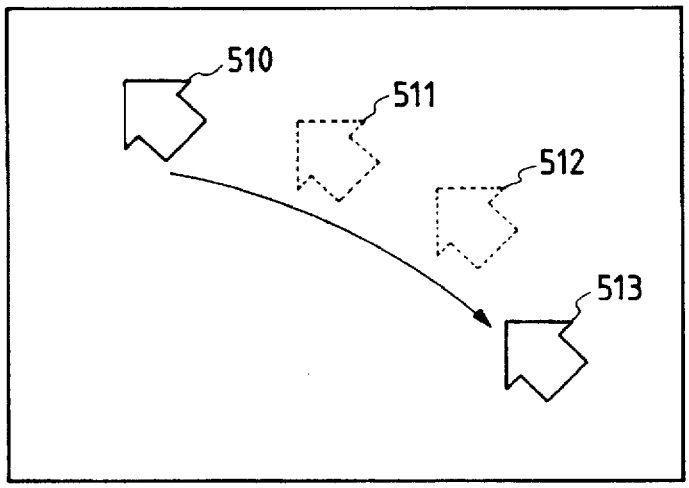
FIG. 37 is a view showing movement of a cursor on a display screen.

FIG. 37 is a view showing movement of the cursor on a display screen 501. The cursor before movement is represented by a cursor 510, the cursors during movement are represented by cursors 511 and 512, and a cursor after movement is represented by a cursor 513.

Figure 38:
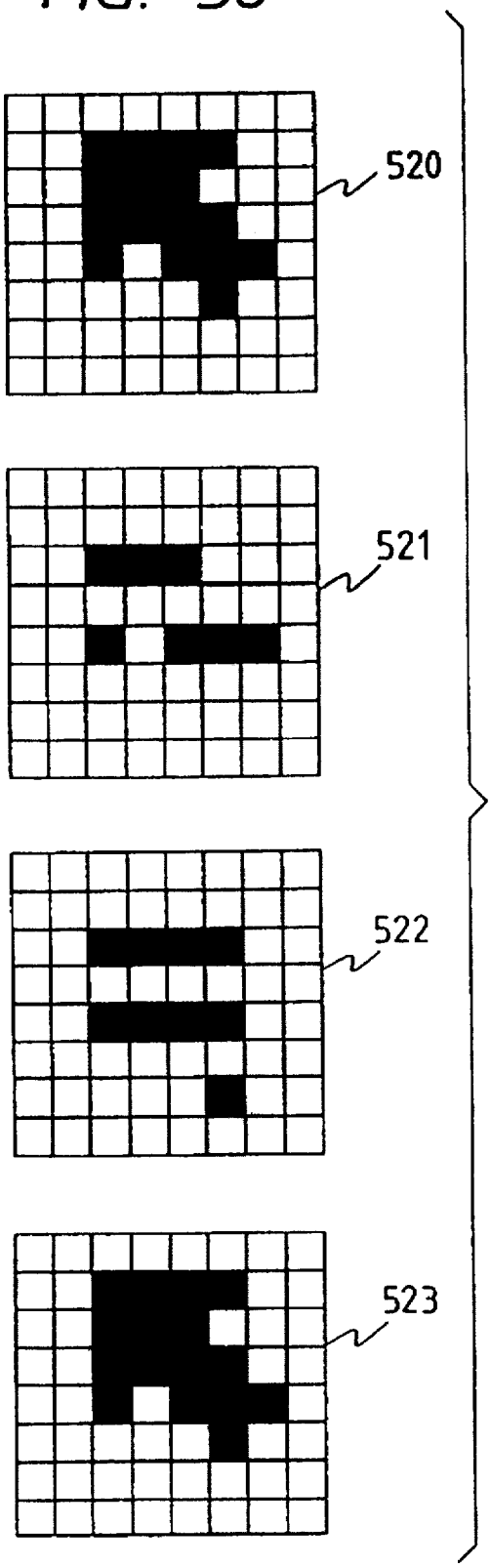
FIG. 38 is a view showing arrangements of cursor dots.

FIG. 38 is a view showing dot arrangements 520, 521, 522, and 523 corresponding to the cursors 510, 511, 512, and 513 in FIG. 37. These arrangements are obtained when interlace display is performed every other dot.

Fifth Embodiment

The fifth embodiment of the present invention will be described below.

In the fourth embodiment, the interlace display is performed during movement of the hardware cursor. However, as a drawing sequence during movement, if part of the cursor shape is written and shifted every given dots in the cursor movement direction, the same effect as in the interlace display can be obtained.

Figure 39:
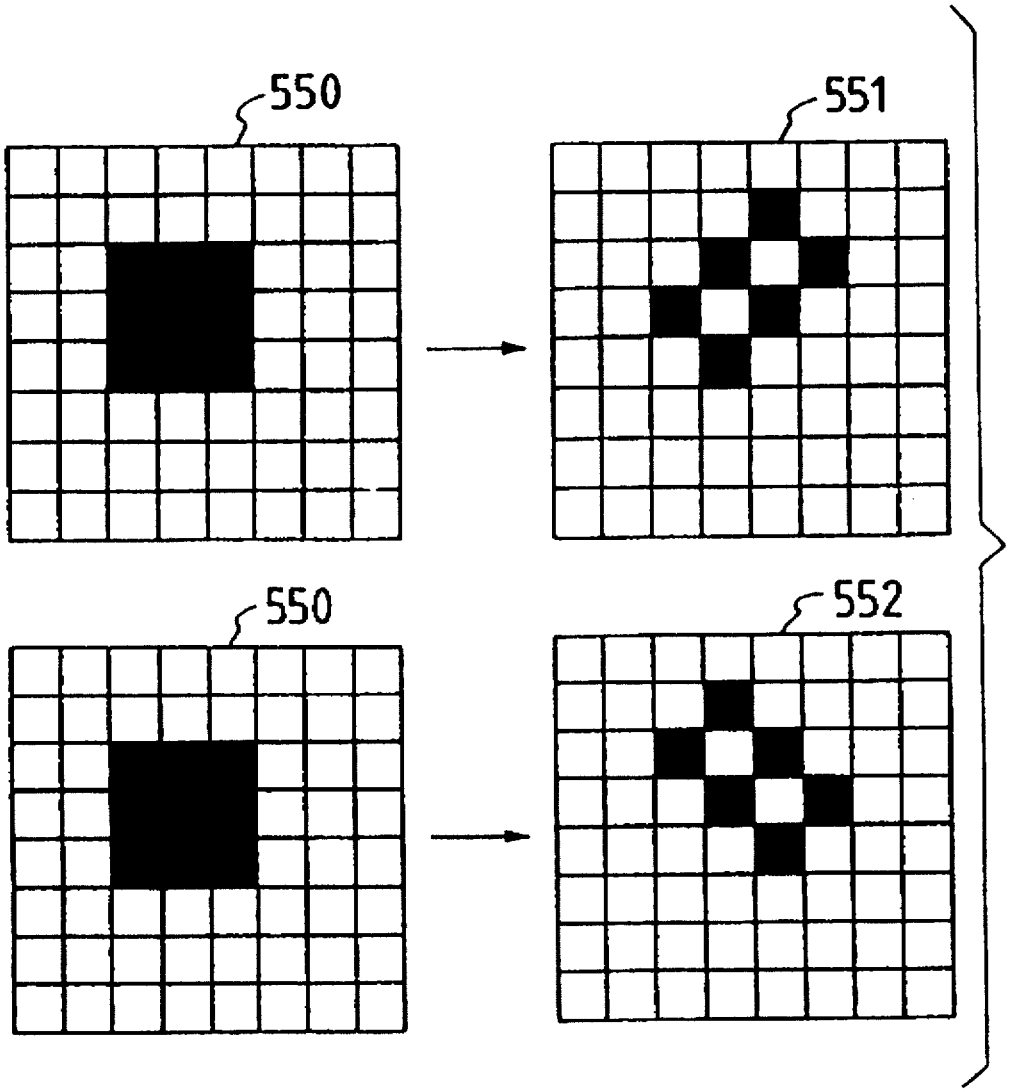
FIG. 39 a view showing arrangements of cursor dots according to the fifth embodiment of the present invention.

As shown in FIG. 39, a display shape during movement is determined in accordance with the shape and movement direction of a hardware cursor. The determined shape is displayed during movement of the hardware cursor. Referring to FIG. 39, the initial cursor shape is represented by a shape 550. When this cursor is moved in the upper right or lower left direction, the cursor is displayed using a shape 551. When the cursor is moved in the upper left or lower right direction, the cursor is displayed using a shape 552. Note that the moving direction can be easily detected in accordance with values of a position register 305 before and after the movement.

The shape of the hardware cursor is not limited to a specific shape, and the interlacing may be performed every other dot or every n dots.

If interlacing is performed every n dots during the movement of the cursor, the number of dots to be interlaced may variably fall within the range of 1 to n in accordance with the cursor moving speed.

Figure 40:
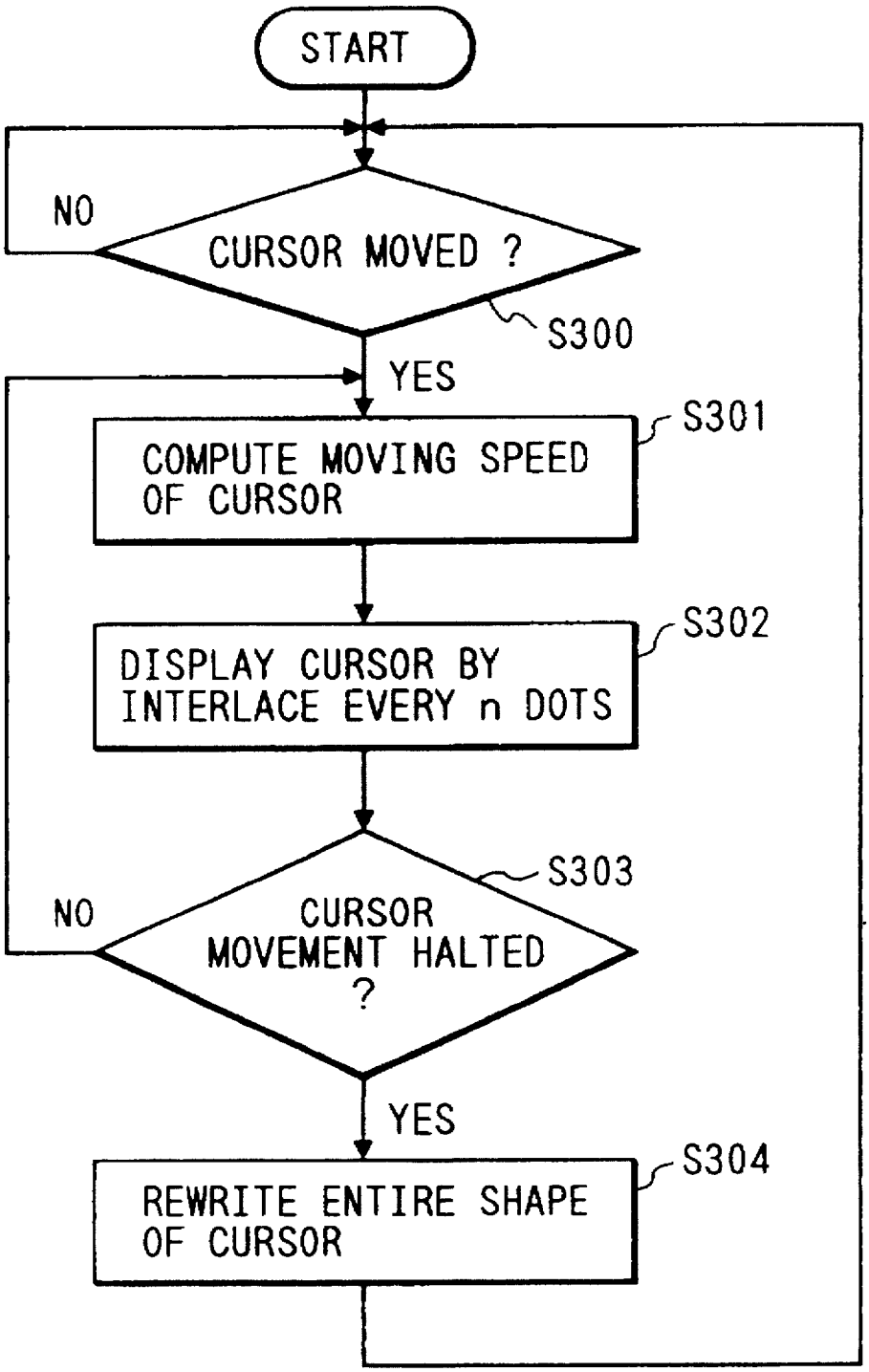
FIG. 40 is a flow chart showing a process according to the fifth embodiment of the present invention.

FIG. 40 is a flow chart showing the operation of the fifth embodiment.

Referring to FIG. 40, the movement/halt of the cursor is determined in accordance with whether the position register 305 is rewritten (S300). If the cursor is moved, the cursor moving speed is computed on the basis of the information of the position register 305 (S301). The dots are interlaced every n dots in accordance with the moving speed (S302). It is then determined whether the cursor movement is halted (S303). If YES in step S303, the entire shape of the cursor is displayed (S304).

As described above, during movement of the hardware cursor, the cursor is displayed by interlace driving. Therefore, the moving/drawing performance of the hardware cursor can be improved, and high-speed response can be achieved during the movement of the hardware cursor.

Sixth Embodiment

The sixth embodiment of the present invention will be described below.

Figure 41:
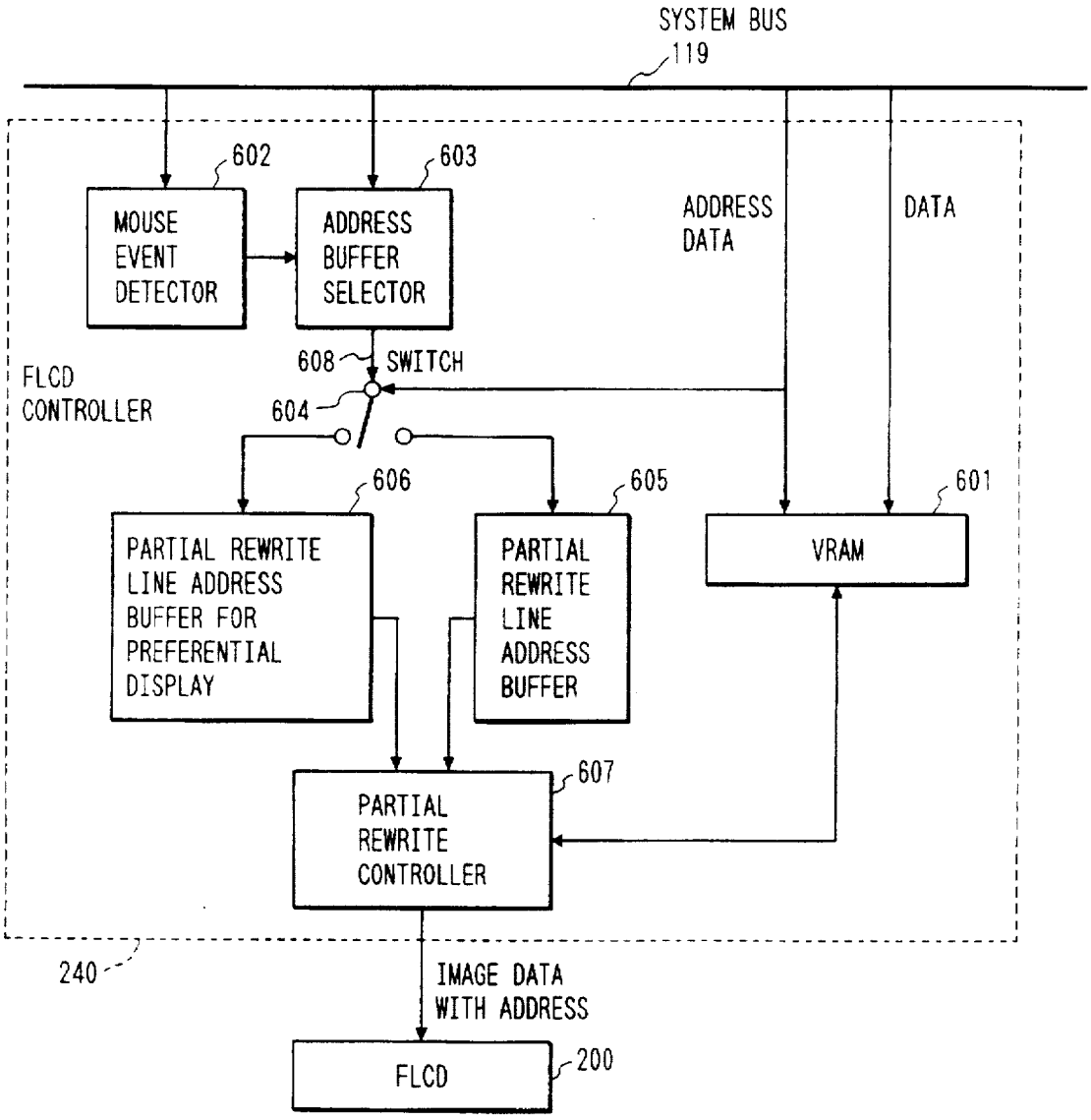
FIG. 41 is a detailed block diagram of an FLCD interface according to the sixth embodiment of the present invention.

FIG. 41 is a detailed block diagram of an FLCD I/F 240.

Referring to FIG. 41, a VRAM 601 can be accessed from both a host CPU 101 and a partial rewrite controller 607. The host CPU 101 writes display data as a bit map in the VRAM 601 through a system bus 119. At this time, address data is sent to a partial rewrite line address buffer 605 or a partial rewrite line address buffer 606 for preferential display. When a mouse event detector 602 detects a mouse drawing operation, the detector 602 supplies a mouse event signal to an address buffer selector 603. The address buffer selector 603 receives the mouse event signal and a mouse cursor preferential display signal from the system CPU 101 and operates a switch 604 in response to these signals. The flow chart of a detailed operation of the address buffer selector 603 will be described later. The switch 604 selects the partial rewrite line address buffer 605 or the partial line address buffer 606 for preferential display as a partial rewrite address data destination. The buffer 605 stores a partial rewrite line address. Absolute address data for causing the CPU 101 to access the VRAM 601 to perform a rewrite operation of a display content or the like is converted to a display line address, and this converted display line address is stored in the partial rewrite line address buffer 605. The address buffer 605 is a double buffer in which the two buffers alternately perform input and output operations every predetermined period of time. The buffer 606 stores a partial rewrite line address for preferential display and has the same function as that of the partial rewrite line address buffer 605. Subsequent read access of the line address from the partial rewrite line address buffer 606 for preferential display is performed prior to read access of the line address from the partial rewrite line address buffer 605. The display data in the VRAM 601 which corresponds to the line address stored in the partial rewrite line address buffer 606 for preferential display is preferentially displayed. The partial rewrite controller 607 reads out the line addresses stored in the partial rewrite line address buffer 605 and the partial rewrite line address buffer 606 for preferential display and also reads out the corresponding display data stored in the VRAM 601. The partial rewrite controller 607 multiplexes the display data and the address data and outputs the addresses display data to an FLCD 200. The detailed operation of the partial rewrite controller 607 will be described below. The FLCD 200 displays the addressed display data, transferred from an FLCD I/F, on one addressed line.

Figure 42:
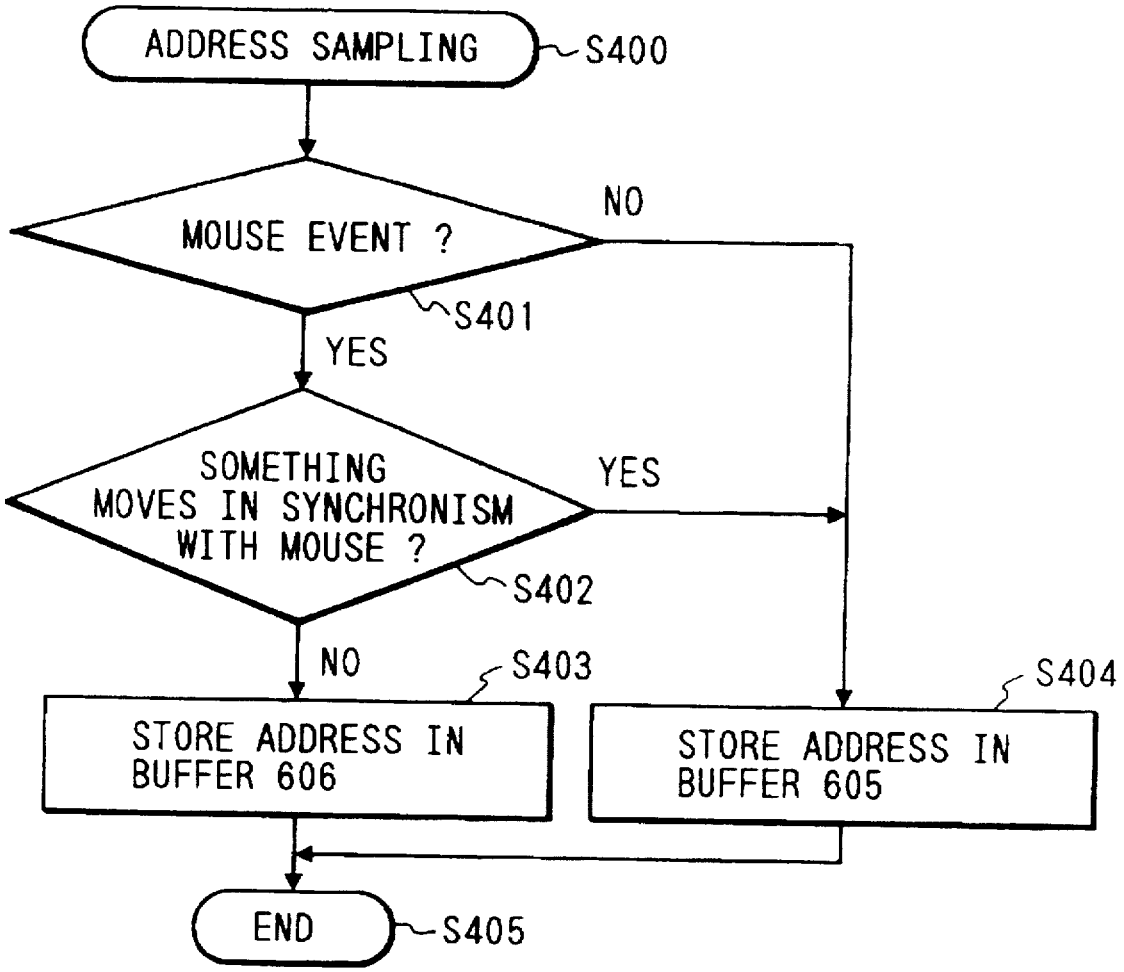
FIG. 42 is a flow chart showing a process of an address storage buffer selector according to the sixth embodiment of the present invention.

The operation of the address buffer selector 603 will be described with reference to a flow chart in FIG. 42.

The mouse event detector 601 determines in step S401 whether current access to the VRAM 601 is caused by a mouse event. The mouse event detector 601 informs the address buffer selector 603 of the determination result. This determination is performed by monitoring an address to be accessed upon generation of the mouse event. If NO in step S401, the address is stored in the buffer 605. It is determined in step S402 whether something moves in synchronism with the mouse. This determination is performed by software such as a device driver or a window manager operated under the control of the host CPU 101. The determination result is informed to the address buffer selector 603. It may be determined whether something moves in synchronism with the mouse cursor in accordance with a hardware means. If NO in step S402, the address is stored in the buffer 606 for preferential display. However, if YES in step S402, the address is stored in the buffer 605.

Figure 43:
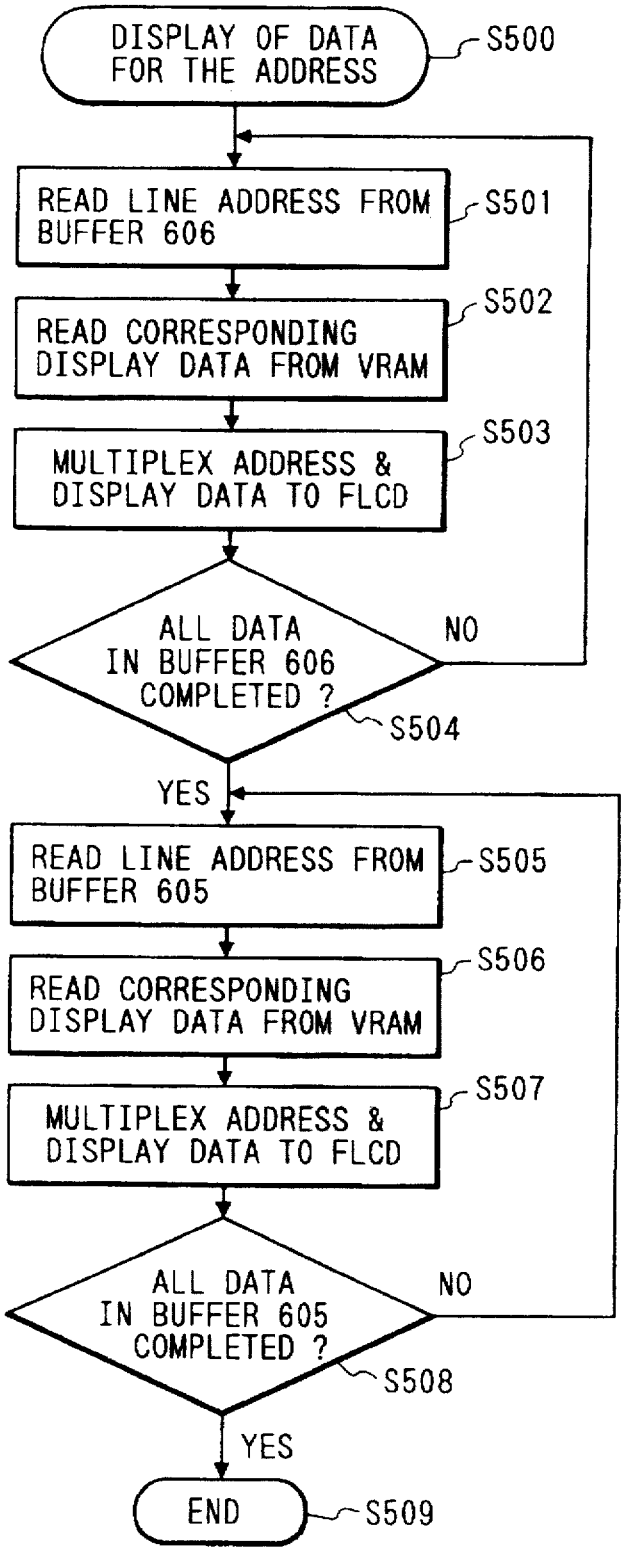
FIG. 43 is a flow chart showing a process of a partial rewrite circuit according to the sixth embodiment of the present invention.

The operation of the partial rewrite controller 607 will be described with reference to a flow chart in FIG. 43.

In step S501, a line address is read out from the rewrite line address buffer 606 for preferential display. In step S502, display data corresponding to this line address is read out from the VRAM 601. In step S503, the address is multiplexed with the display data, and the multiplexed data is output to the FLCD 200. A process in steps S501 to S503 is repeated for all the address data in the buffer 606. In steps S505 to S508, the same operations as described above are performed for the rewrite line address buffer 605. A process for the rewrite line address buffer 606 for preferential display is performed prior to the operations of the rewrite line address buffer 605.

In the above process, if an area moved in synchronism with the mouse cursor is not present, the mouse cursor is preferentially displayed. Otherwise, the mouse cursor is not preferentially displayed.

Seventh Embodiment

The seventh embodiment of the present invention will be described below. The presence/absence of preferential display of a mouse cursor is determined in accordance with the size of an area moved in synchronism with the mouse cursor.

Figure 44:
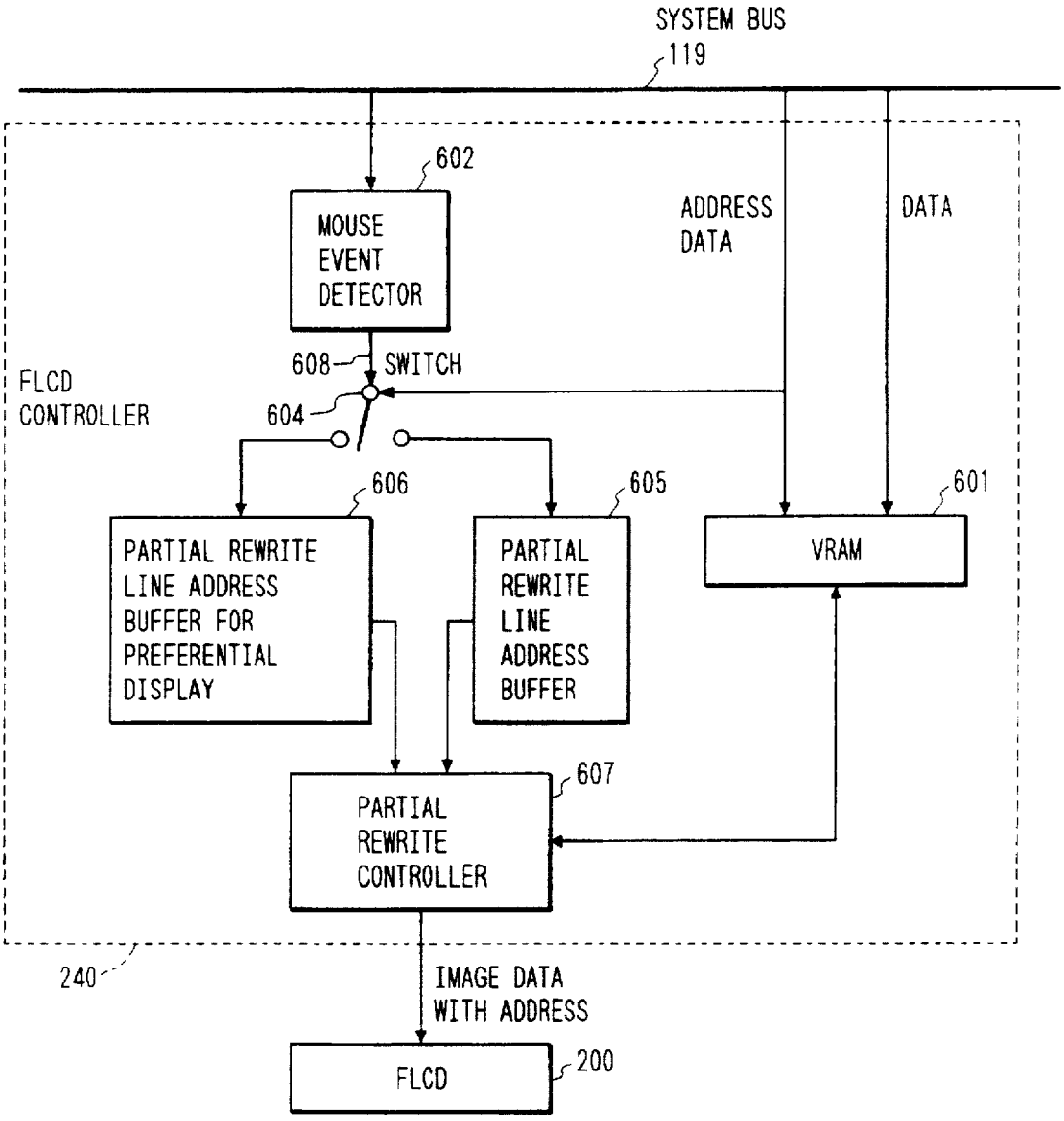
FIG. 44 is a detailed block diagram of an FLCD interface according to the seventh embodiment of the present invention.

FIG. 44 is a detailed block diagram of an FLCD interface 240 according to the seventh embodiment.

Referring to FIG. 44, a VRAM 601 can be accessed from both a host CPU 101 and a partial rewrite controller 607. The host CPU 101 writes display data as a bit map in the VRAM 601 through a system bus 119. At this time, address data is sent to a partial rewrite line address buffer 605 or a partial rewrite line address buffer 606 for preferential display. When a mouse event detector 602 detects a mouse drawing operation, the detector 602 changes over a switch 604 to the address buffer 606. The switch 604 selects the partial rewrite line address buffer 605 or the partial line address buffer 606 for preferential display as a partial rewrite address data destination. The buffer 605 stores a partial rewrite line address. Absolute address data for causing the CPU 101 to access the VRAM 601 to perform a rewrite operation of a display content or the like is converted to a display line address, and this converted display line address is stored in the partial rewrite line address buffer 605. The address buffer 605 is a double buffer in which the two buffers alternately perform input and output operations every predetermined period of time. The buffer 606 stores a partial rewrite line address for preferential display and has the same function as that of the partial rewrite line address buffer 605. A partial rewrite controller 607 reads out the line addresses stored in the partial rewrite line address buffer 605 and the partial rewrite line address buffer 606 for preferential display and also reads out the corresponding display data stored in the VRAM 601. The partial rewrite controller 607 multiplexes the display data and the address data and outputs the addresses display data to an FLCD 200. The detailed operation of the partial rewrite controller 607 will be described below. The FLCD 200 displays the addressed display data, transferred from an FLCD I/F, on one addressed line.

Figure 45:
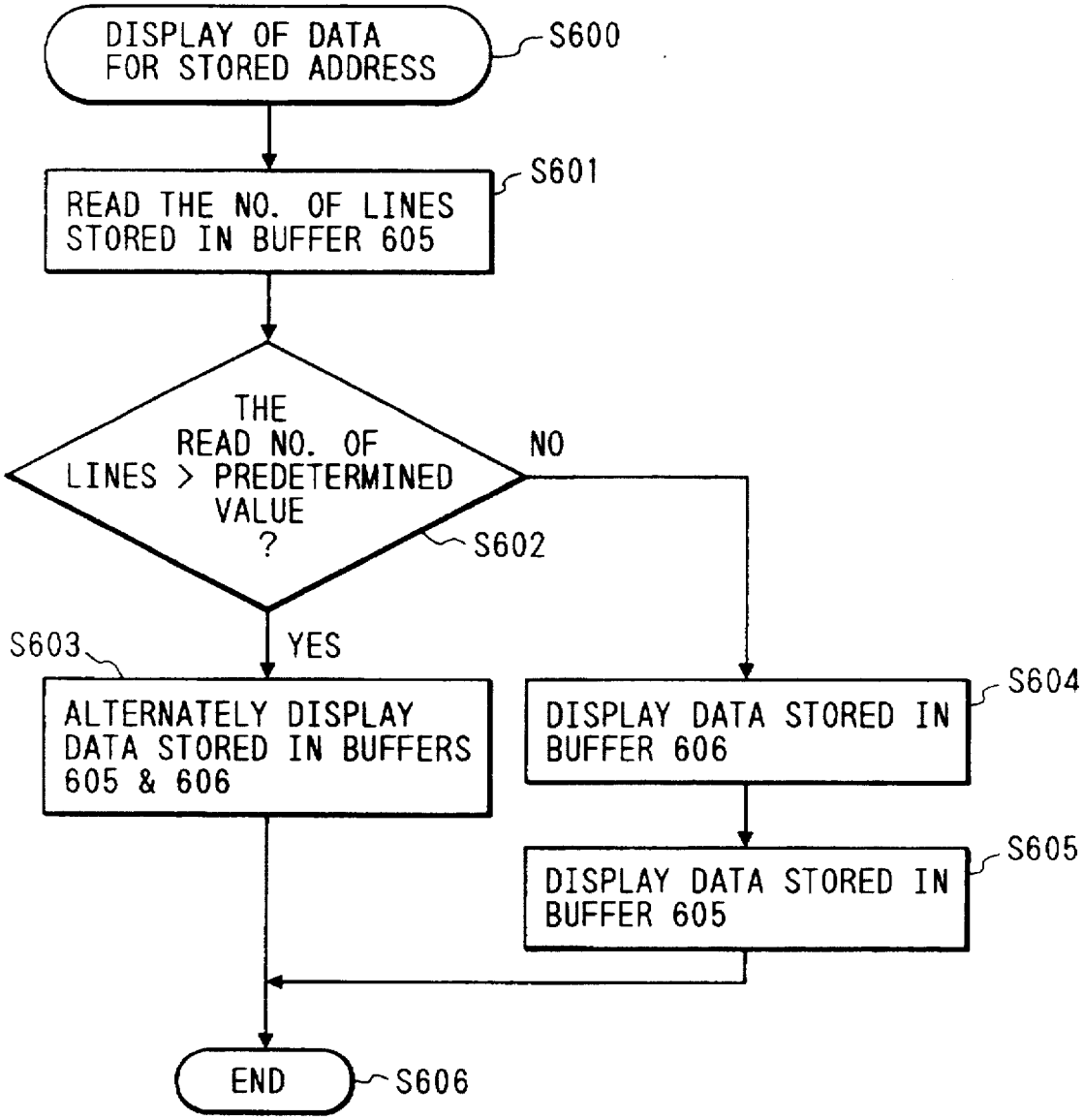
FIG. 45 is a flow chart showing a process of a partial rewrite circuit according to the seventh embodiment of the present invention.

The operation of the partial rewrite controller 607 will be described with reference to a flow chart in FIG. 45.

In step S601, the number of lines stored in the partial rewrite line address buffer 605 is read. It is determined in step S602 whether the number of lines exceeds a predetermined value. This value is appropriately determined in accordance with the system performance, the display speed of the FLCD 200, and the like. If the number of lines exceeds the predetermined value, step S603 is executed to inhibit the preferential display of the mouse cursor. Otherwise, to perform the preferential display of the mouse cursor, steps S604 and S605 are performed. In step S603, data corresponding to the line address in the rewrite line address buffer 606 for preferential display and the line address in the rewrite line address buffer 605 are alternately displayed. In step S604, data corresponding to the line address in the rewrite line address buffer 606 for preferential display is displayed. In step S605, data corresponding to the line address in the rewrite line address buffer 605 is performed.

By the above process, if the size of an area moved in synchronism with the mouse cursor is a predetermined value or less, the mouse cursor is preferentially displayed. However, if the size of the area moved in synchronism with the mouse cursor is larger than the predetermined value, the mouse cursor is not preferentially displayed.

According to the present invention, attention is paid to a cursor to display display data, so that natural display can be performed.

What is claimed is:

1. A display control apparatus for a display device capable of updating a display state for a display element subjected to a change in display, comprising:

display data memory means for storing display data and a specific pattern in different memory areas;

a display controller capable of sequentially reading out the display data stored in said display data memory means and transferring the readout display data to the display device at a predetermined period and performing a partial rewrite operation of the display data stored in said display data memory means;

rewrite detecting means for detecting an address for accessing said display data memory means to cause said display controller to perform the partial rewrite operation;

specific pattern rewrite detecting means for detecting a rewrite operation of the specific pattern stored in said display data memory means; and address generating means for, when said rewrite detecting means detects the address for accessing said display data memory means, generating a reading address of said display data memory means corresponding to the detected address, and when said specific pattern rewrite detecting means detects the rewrite operation of the specific pattern, generating a reading address of said display data memory means corresponding to a size of the specific pattern.

2. An apparatus according to claim 1, wherein the specific pattern includes a cursor pattern.

3. An apparatus according to claim 1, further comprising means for storing a display data flag indicating that display data has been rewritten and means for storing a specific pattern flag indicating that a specific pattern has been rewritten, wherein the specific pattern is preferentially displayed in response to the specific pattern flag being stored in said specific pattern flag storage means.

4. An apparatus according to claim 1, wherein said address generating means generates the reading address corresponding to the size of the specific pattern in preference to the reading address corresponding to the detected address.

5. An apparatus according to claim 1, further comprising control means for controlling synthesis of the specific pattern and the display data designated by the reading address generated correspondingly to the size of the specific pattern and controlling the display device to display the synthesized data.

6. An apparatus according to claim 1, wherein the display device comprises a FLCD.

7. A display control apparatus for a display device capable of updating a display state for a display element subjected to a change in display, comprising:

display data memory means for storing display data and a specific pattern in different memory areas;

a display controller capable of sequentially reading out the display data stored in said display data memory means and transferring the readout display data to the display device at a predetermined period and performing a partial rewrite operation of the display data stored in said display data memory means;

rewrite detecting means for detecting addresses for accessing said display data memory means to cause said display controller to perform the partial rewrite operation;

specific pattern rewrite detecting means for detecting an address of the display data subjected to a rewrite operation of the specific pattern in said display data memory means; and read inhibiting means for inhibiting a read operation of said display controller for display data displayed in a transparent manner on the display device among the display data whose addresses are detected by said specific pattern rewrite detecting means.

8. An apparatus according to claim 7, wherein the specific pattern includes a cursor pattern.

9. A display control apparatus comprising:

first memory means for storing display data and a specific pattern in different memory areas;

rewriting means for rewriting the display data stored in said first memory means;

detection means for detecting movement of a cursor on the basis of an address of the cursor;

address generating means for, in response to detection of the cursor movement by said detecting means, generating an address of said memory means corresponding to a position of the cursor before the cursor movement and an address of said memory means corresponding to a position of the cursor after the cursor movement; and control means for reading the display data from said first memory means in accordance with the addresses generated by said address generating means and for controlling a display device to display the read display data.

10. An apparatus according to claim 9, further comprising second memory means for storing information indicating that the cursor has been moved, wherein said control means controls the display device depending on whether said second memory means stores such information.

11. An apparatus according to claim 10, wherein said second memory means stores the information in correspondence to each display line of the display device.

12. An apparatus according to claim 9, wherein the display device comprises a FLCD.

13. An apparatus according to claim 9, wherein said control means synthesizes the display data with the specific pattern and controls the display device to display the display data as synthesized with the specific pattern, when displaying the display data in accordance with the address generated corresponding to the cursor position after the cursor movement.

14. A method according to claim 9, wherein said control step synthesizes the display data with the specific pattern and controls the display apparatus to display the display data as synthesized with the specific pattern, when displaying the display data in accordance with the address generated display data in accordance with the address generated corresponding to the cursor position after the cursor movement.

15. A display control method comprising the steps of:

storing display data and a specific pattern in different areas of a memory;

detecting movement of a cursor of a display apparatus on the basis of an address of the cursor;

generating, in response to detection of the cursor movement, an address of the memory corresponding to a position of the cursor before the cursor movement and an address of the memory corresponding to a position of the cursor after the cursor movement;

reading the display data from the memory in accordance with the generated addresses; and controlling the display apparatus to display the read display data.

16. A method according to claim 15, wherein the display apparatus comprises a FLCD.

17. A display control method comprising the steps:

storing display data and specific pattern display data in different areas of a memory;

sequentially reading out the display data stored in the memory and transferring the readout display data to a display device at a predetermined period and performing a partial rewrite operation of the display data stored in the memory;

detecting addresses for accessing the display data in the memory to cause a display controller to perform a partial rewrite operation;

detecting an address of the display data subjected to a rewrite operation of a specific pattern in the display data memory; and inhibiting a read operation of display data displayed in a transparent manner on the display device among the display data whose addresses are detected.

18. A display control apparatus comprising:

supply means for supplying display data;

first memory means for storing the display data supplied by said supply means and a specific pattern in different memory areas;

rewriting means for rewriting the display data stored in said memory means;

detection means for detecting movement of a cursor on the basis of an address of the cursor;

address generating means for, in response to a detection of the cursor movement by said detecting means, generating an address of said memory means corresponding to a position of the cursor before the cursor movement and an address of said memory means corresponding to a position of the cursor after the cursor movement; and control means for reading the display data from said first memory means in accordance with the addresses generated by said address generating means and for controlling a display device to display the read display data.

19. An apparatus according to claim 18, wherein the display device comprises a FLCD.

20. An apparatus according to claim 18, wherein said control means synthesizes the display data with the specific pattern and controls the display device to display the display data as synthesized with the specific pattern, when displaying the display data in accordance with the address generated corresponding to the cursor position after the cursor movement.

* * * * *

UNITED STATES PATENT AND TRADEMARK OFFICE

CERTIFICATE OF CORRECTION

PATENT NO. : 5,736,981

DATED : April 7, 1998

INVENTOR(S) : Nobutani et al.

It is certified that error appears in the above-identified patent and that said Letters Patent is hereby corrected as shown below:

COLUMN 5:

Line 11, "the" (second occurrence) should be deleted.

COLUMN 11:

Line 37, "get" should read --set--.

COLUMN 24:

Line 43, "dis-" should be deleted.
Line 44, "play data in accordance with the address generated" should be deleted.

Signed and Sealed this

Tenth Day of November 1998

*Attest:*

*Attesting Officer*

BRUCE LEHMAN

*Commissioner of Patents and Trademarks*